US006822388B2

(12) United States Patent
Kijima et al.

(10) Patent No.: US 6,822,388 B2
(45) Date of Patent: Nov. 23, 2004

(54) DISPLAY DEVICE WITH PLATE-LIKE CONTROL ELECTRODES

(75) Inventors: Yuuichi Kijima, Chousei (JP); Kenji Miyata, Hitachinaka (JP); Yoshiyuki Kaneko, Hachioji (JP); Shigemi Hirasawa, Chiba (JP); Susumu Sasaki, Chiba (JP); Hiroshi Kawasaki, Ooamishirasato (JP); Jun Ishikawa, Mobara (JP)

(73) Assignees: Hitachi, Ltd., Tokyo (JP); Hitachi Device Engineering, Co., Chiba-Ken (JP)

( * ) Notice: Subject to any disclaimer, the term of this patent is extended or adjusted under 35 U.S.C. 154(b) by 151 days.

(21) Appl. No.: 10/338,328

(22) Filed: Jan. 8, 2003

(65) Prior Publication Data

US 2003/0151353 A1 Aug. 14, 2003

(30) Foreign Application Priority Data

Feb. 12, 2002 (JP) ..... 2002-033683

(51) Int. Cl.[7] ..... H01J 1/62; H01J 63/04; H01J 1/02; H01J 1/46

(52) U.S. Cl. ..... 313/497; 313/495; 313/496; 313/309; 313/310; 313/351; 313/293

(58) Field of Search ..... 313/495–497, 313/309–311, 293, 301–304, 348–351

(56) References Cited

U.S. PATENT DOCUMENTS 5,548,185 A * 8/1996 Kumar et al. ..... 313/495
5,909,033 A * 6/1999 Koga et al. ..... 257/10
2002/0167265 A1 11/2002 Miyata et al.
2002/0167266 A1 11/2002 Hirasawa et al.

* cited by examiner

*Primary Examiner*—Ashok Patel
*Assistant Examiner*—Matt Hodges
(74) *Attorney, Agent, or Firm*—Milbank, Tweed, Hadley & McCloy LLP

(57) ABSTRACT

A display device of the present invention reduces the occurrence of cracks and breaking of plate-like control electrodes, enhances the operability of assembling and suppresses the reduction of a yield factor of products. The display device includes a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween. The control electrodes are formed of plate-like control electrodes. The plate-like control electrode includes electron passing holes which allow electrons emitted from the electron sources to pass therethrough in the display region. Further, the plate-like control electrode has a portion which is fixed to the back substrate in an external non-display region. Still further, the plate-like control electrode has at least a portion in the external non-display region where the strength of the plate-like control electrode is gradually changed toward an end portion thereof in the extending direction.

30 Claims, 16 Drawing Sheets

$P0<P1<P2<P3<\cdots<Pn$, $W0=W1=W2=W3=\cdots=Wn$, $d0\leqq d1<d2<d3<\cdots<dn$

P0<P1<P2<P3< · · · <Pn, W0>W1>W2>W3> · · · >Wn, d0≦d1<d2<d3< · · · <dn $P0 \leqq P1 < P2 < P3 < P4 < \cdots < Pn$, $D0 = D1 = D2 = D3 = D4 = \cdots = Dn$ P0=P1=P2=P3=P4=・・・=Pn, D0>D1>D2>D3>D4>・・・>Dn D0=D1=D2≧D3≧D4≧D5>D6>D7>D8> · · · >Dn P0=P1=P2=P3≦P4≦P5<P6<P7<P8< · · · <Pn

DISPLAY DEVICE WITH PLATE-LIKE CONTROL ELECTRODES

BACKGROUND OF THE INVENTION

The present invention relates to a display device which utilizes emission of electrons into vacuum, and more particularly to a display device which enhances stable display characteristics by mounting cathode lines which have electron sources and control electrodes which control an electron pulling quantity (electron emission quantity) from the electron sources with high accuracy.

A color cathode ray tube has been popularly used conventionally as a display device which exhibits excellent properties such as high luminance and high definition. However, along with a demand for high image quality in recent information processing apparatuses and television broadcasting, a demand for a planar display (panel display) which is light-weighted and requires a small-space while ensuring properties such as high luminance and high definition is increasing.

As a typical example of such a planar display, a liquid crystal display device, a plasma display device and the like have been commercialized. Further, as the planar display device which can realize the high luminance, various types of panel-type display devices including a display device which makes use of emission of electrons from an electron source into vacuum (hereinafter, referred to as an electron emission type display device or a field emission type display device), an organic EL display which is characterized by its low power consumption and the like are expected to be commercialized soon.

Among such panel-type display devices, as the field emission type display device, a display device having an electron emission structure which is proposed by C. A. Spindt et al., a display device having a metal-insulator-metal (MIM) type electron emission structure, a display device having an electron emission structure which makes use of an electron emission phenomenon based on a quantum theory tunneling effect (also referred to as a surface conductive type electron source), a display device which makes use of an electron emission phenomenon possessed by a diamond film, a graphite film or a carbon nanotube and the like have been known.

The field emission type display device includes a back panel which forms cathode lines having field emission type electron sources and control electrodes on an inner surface thereof and a front panel which forms anodes and phosphors materials on an inner surface thereof which faces the back panel in an opposed manner, wherein the display device is constituted by laminating both panels while inserting a sealing frame between inner peripheries of both panels and by evacuating the inside thereof. Further, to hold a distance between the back panel and the front panel at a given value, distance holding members are provided between the back panel and the front panel.

FIG. 17 is a plan view of a back panel for explaining the schematic constitution of a field emission type display device. Here, FIG. 17 is constituted of a schematic view as viewed from a front panel side. With respect to the constitution which is explained in conjunction with the drawing, a technique which is relevant to fixing of control electrodes is the constitution which the applicant of the present invention has conceived in the process of reviewing the present invention and hence, the technique does not constitute a known technique. The back panel includes a plurality of cathode lines 2 having electron sources and a plurality of control electrodes 4 on a back substrate 1 which is preferably be made of glass, alumina or the like. A large number of cathode lines 2 extend in one direction and are arranged in parallel in another direction which crosses one direction on the back substrate 1. The cathode lines 2 are patterned by printing a conductive paste including silver or the like and cathode-line lead lines 20 are pulled to the outside of a sealing frame 9 from end portions of the cathode lines 2.

The control electrodes 4 shown in FIG. 17 are constituted of plate members which are manufactured as separate members. The control electrodes 4 are arranged above and close to the cathode lines 2 having the electron sources. A large number of control electrode 4 extend in the above-mentioned another direction and are arranged in parallel in the above-mentioned one direction. The control electrodes are explained as plate-like control electrodes 4 hereinafter. These plate-like control electrodes 4 are fixed to the back substrate 1 at fixing portions provided outside a display region AR using a pressing members 6 which are formed of an insulator such as a glass material. In the vicinity of the fixing portions, leads (plate-like control electrode leads) 50 are connected to the plate-like control electrodes 4 and are pulled out to the outside of the sealing frame 9. Pixels are formed on respective crossing portions between the cathode lines (electron sources provided to the cathode lines) 2 and the control electrodes 4. Here, the sealing frame 9 may be provided with a function of the pressing member 6.

An emission quantity (including ON and OFF) of electrons from the electron sources provided to the cathode lines 2 is controlled based on a potential difference between the cathode lines 2 and the control electrodes 4. On the other hand, the front panel not shown in the drawing includes anodes and phosphors on a front substrate which is made of a light-transmitting material such as glass. The phosphors are formed corresponding to the pixels formed at the crossing portions between the cathode lines 2 and the plate-like control electrodes 4.

The inside of the display device sealed by the sealing frame 9 is evacuated to a vacuum of $10^{-5}$–$10^{-7}$ Torr, for example. Each crossing portion between the control electrode 4 and the cathode line 2 includes electron passing holes not shown in the drawing and these electron passing holes allow the electrons emitted from the electron source of the cathode line 2 to pass therethrough toward the anode side. The above-mentioned electron source is, for example, constituted of carbon nanotubes (CNT), diamond-like carbon (DLC) or other field emission cathode.

On the back substrate 1 on which the cathode lines 2 are formed, it is necessary to mount the plate-like control electrodes 4 at a given distance over the whole area of the display region AR with respect to the cathode lines 2. FIG. 18 is a plan view for explaining the shape of the plate-like control electrodes 4 as parts before mounting them on the back substrate 1. The structure of the plate-like control electrodes 4 shown in FIG. 18, the manufacturing method and the mounting method of the plate-like control electrodes 4, and the detailed structure of the plate-like control electrodes 4 are conceived by the applicant of the present application in the stage of reviewing the present invention and hence, they do not constitute known techniques. The plate-like control electrodes 4 are formed usually such that an aluminum-based or an iron-based thin plate is formed into a large number of stripe-shaped thin plates and a large number of electron passing holes are formed in these stripe-like thin plates by etching using a photolithography technique.

The plate-like control electrodes 4 which constitute parts are in a state that they are held by a frame 40. At the time of mounting the plate-like control electrodes 4 to the back substrate 1, the plate-like control electrodes 4 are positioned on the cathode lines 2 formed on the back substrate 1 together with the frame 40, and the outside of the display region AR is fixed by the pressing member 6 (FIG. 17). Thereafter, the frame 40 is cut and removed.

As explained in conjunction with FIG. 18, the plate-like control electrodes 4 are formed of thin plates formed by etching having a small thickness (approximately 0.05 mm) and hence, there exists a portion where a mechanical strength is sharply changed (a stress concentration portion to which a force is applied from outside) in the vicinity of a boundary region between a region where the electron passing holes are formed which is formed in the display region AR and the fixing portion formed of the pressing members 6 or the sealing frame 9. The mounting of the plate-like control electrodes 4 includes a step in which the pressing members 6 are fixed by applying a tension to the pressing member 6 in the extending direction (longitudinal direction) for ensuring a given distance between the cathode lines 2 and the plate-like control electrodes 4. In this step, cracks or breaking a reliable to occur in the plate-like control electrodes 4 so that the operability and the yield factor of products are degraded. Further, even with respect to a state of products after assembling, cracks may occur in the vicinity of the above-mentioned boundary region due to the repeated thermal expansion during the operation and the plate-like control electrodes 4 may break in an extreme case thus lowering the reliability of the products.

SUMMARY OF INVENTION

Accordingly, it is an object of the present invention to provide a display device which exhibits high reliability by preventing the occurrence of cracks and breaking of plate-like control electrodes 4 and by enhancing the operability at the time of assembling and the yield factor of products.

To achieve the above-mentioned object, the present invention provides the structure which prevents a sharp change of mechanical strength in the vicinity of a boundary between the display region of plate-like control electrodes and a fixing portion provided to a back panel to the plate-like control electrodes. Typical constitutions of the present invention are as follows.

(1). In a display device comprising a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, the control electrodes are formed of plate-like control electrodes, the plate-like control electrode includes electron passing holes which allow electrons emitted from the electron sources to pass therethrough in the display region, the plate-like control electrode has a portion which is fixed to the back substrate in an external non-display region, and the plate-like control electrode has a region where the strength of the plate-like control electrode is gradually changed toward an end portion thereof in the extending direction in at least a portion of the external non-display region.

(2). In the above-mentioned constitution (1), the plate-like control electrode has a region where the strength is gradually increased toward the end portion thereof in the extending direction.

(3). In the above-mentioned constitution (1) or (2), the strength of the plate-like control electrode is gradually increased from a boundary of the display region to a portion which is fixed to the back substrate.

(4). In any one of the above-mentioned constitutions (1) to (3), the strength of the plate-like control electrode is gradually increased from a portion which is fixed to the back substrate toward an end portion in the extending direction in the plate-like control electrode.

(5). In the above-mentioned constitution (1), the plate-like control electrode has the strength in the vicinity of a boundary of the display region which is substantially equal to the strength within the display region, and the strength is gradually increased from an intermediate portion of the external non-display region toward the end portion in the extending direction.

(6). In the above-mentioned constitution (1), the plate-like control electrode has the strength in a range from a boundary of the display region to a portion which is fixed to the back substrate which is substantially equal to the strength within the display region, and the strength is gradually increased outside the portion which is fixed to the back substrate toward the end portion in the extending direction.

(7). In any one of the above-mentioned constitutions (1) to (6), the plate-like control electrode has holes in at least a portion of the external non-display region.

(8). In any one of the above-mentioned constitutions (1) to (7), the plate-like control electrode has protrusions which protrude toward the back substrate side in the display region and the external non-display region.

(9). In any one of the above-mentioned constitutions (1) to (8), the plate-like control electrode includes a region where the width of the plate-like control electrode is gradually reduced toward the end portion in the extending direction in at least a portion of the external non-display region.

(10). In any one of the above-mentioned constitutions (1) to (9), the plate-like control electrode is fixed to the back substrate even within the display region.

(11). Ina display device comprising a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, the control electrodes are formed of plate-like control electrodes, the plate-like control electrode includes electron passing holes which allow electrons emitted from the electron sources to pass therethrough in the display region, the plate-like control electrode has a portion which is fixed to the back substrate in an external non-display region, and holes are formed in at least a portion of the external non-display region.

(12). In the above-mentioned constitution (11), the holes in the external non-display region are formed in a pattern which is substantially equal to a pattern of the electron passing holes formed within the display region.

(13). In the above-mentioned constitution (11), the holes in the external non-display region are formed over a substantially entire area of the external non-display region in a pattern substantially equal to a pattern of the electron passing holes formed within the display region.

(14). In the above-mentioned constitution (11), the plate-like control electrode has a region where pitches of the holes of the external non-display region are gradually increased toward an end portion in the extending direction of the plate-like control electrode.

(15). In the above-mentioned constitution (11), the holes of the external non-display region are formed in a pattern which is substantially equal to a pattern of the electron passing holes in the vicinity of a boundary of the display region and pitches of the holes are gradually increased toward an end portion in the extending direction of the plate-like control electrode from an intermediate portion of the external non-display region.

(16). In the above-mentioned constitution (11), the plate-like control electrode has a region where diameters of the holes of the external non-display region are gradually decreased toward an end portion in the extending direction of the plate-like control electrode.

(17). In the above-mentioned constitution (11), the holes of the external non-display region are formed in a pattern which is substantially equal to a pattern of the electron passing holes in the vicinity of a boundary of the display region and diameters of the holes are gradually decreased toward an end portion in the extending direction of the plate-like control electrode from an intermediate portion of the external non-display region.

(18). In the above-mentioned constitution (11), the plate-like control electrode has a region where pitches of the holes of the external non-display region are gradually increased toward an end portion in the extending direction of the plate-like control electrode, and the plate-like control electrode has a region where diameters of the holes of the external non-display region are gradually decreased toward the end portion in the extending direction of the plate-like control electrode.

(19).In anyone of the above-mentioned constitutions (11) to (18), a pattern of the holes of the external non-display region is formed such that the holes are changed into non-penetrating recessed portion from an intermediate portion of the external non-display region toward an end portion in the extending direction of the plate-like control electrode.

(20). In any one of the above-mentioned constitutions (11) to (19), the plate-like control electrode is fixed to the back substrate even within the display region.

(21). In a display device comprising a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, the control electrodes are formed of plate-like control electrodes, the plate-like control electrode includes electron passing holes which allow electrons emitted from the electron sources to pass therethrough in the display region, the plate-like control electrode has a portion which is fixed to the back substrate in an external non-display region, and holes are formed in at least a portion of the external non-display region, the external non-display region has a region in which a width of the plate-like control electrode is gradually narrowed toward an end portion in the extending direction at least in a portion thereof.

(22). In the above-mentioned constitution (21), the plate-like control electrode has a region where diameters of the holes of the external non-display region are gradually decreased toward the end portion in the extending direction of the plate-like control electrode.

(23). In the above-mentioned constitution (21) or (22), the plate-like control electrode has a region in which the width of the plate-like control electrode is gradually decreased toward the end portion in the extending direction and a subsequent region in which the width of the plate-like control electrode is substantially fixed in at least a portion of the external non-display region.

(24). In any one of the above-mentioned constitutions (21) to (23), the plate-like control electrode is fixed to the back substrate even within the display region.

(25). In a display device comprising aback substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, the control electrodes are formed of plate-like control electrodes, the plate-like control electrode includes electron passing holes which allow electrons emitted from the electron sources to pass therethrough in the display region, includes a portion which is fixed to the back substrate in the external non-display region, and includes protrusions which protrude toward the back substrate side in the display region and in the external non-display region, and at least in a portion of the external non-display region, the protrusions are formed such that a gap between the neighboring protrusions as measured in the extending direction toward an end portion in the extending direction of the plate-like control electrode is set substantially equal and an arrangement pitch in the extending direction is gradually increased.

(26). In a display device comprising a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, the control electrodes are formed of plate-like control electrodes, the plate-like control electrode includes electron passing holes which allow electrons emitted from the electron sources to pass therethrough in the display region, includes a portion which is fixed to the back substrate in the external non-display region, and includes protrusions which protrude toward the back substrate side in the display region and in the external non-display region, and at least in a portion of the external non-display region, the protrusions are formed such that a gap between the neighboring protrusions as measured in the extending direction toward an end portion in the extending direction of the plate-like control electrode is gradually decreased and an arrangement pitch in the extending direction is set substantially the same.

(27). In a display device comprising a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, the control electrodes are formed of plate-like control electrodes, the plate-like control electrode includes electron passing holes which allow electrons emitted from the electron sources to pass therethrough in the display region, includes a portion which is fixed to the back substrate in the external non-display region, and includes protrusions which protrude toward the back substrate side in the display region and in the external non-display region, and at least in a portion of the external non-display region, the protrusions are formed such that a gap between the neighboring protrusions as measured in the extending direction toward an end portion in the extending direction of the plate-like control electrode is gradually decreased and an arrangement pitch in the extending direction is gradually increased.

(28). In any one of the constitutions (25) to (27), the plate-like control electrode includes holes at least in a portion of the external non-display region.

(29). In any one of the constitutions (25) to (28), the plate-like control electrode has indented portions on the front substrate side at positions corresponding to the protrusions in the external non-display region.

(30). In any one of the constitutions (25) to (29), the plate-like control electrode is fixed to the back substrate even in the display region.

Due to the above-enumerated respective constitutions of the present invention, the sharp change of mechanical strength hardly occurs in the vicinity of the boundary of the display region and the fixing portion of the display device which uses the plate-like control electrodes whereby the occurrence of cracks and breaking is prevented, the operability of assembling is enhanced, the yield factor of products is enhanced thus producing the highly reliable display device.

It is needless to say that the present invention is not limited to the above-mentioned constitutions and constitutions of embodiments which are explained hereinafter and various modifications are conceivable without departing from the technical concept of the present invention.

DESCRIPTION OF THE PREFERRED EMBODIMENTS

Figure 1A:
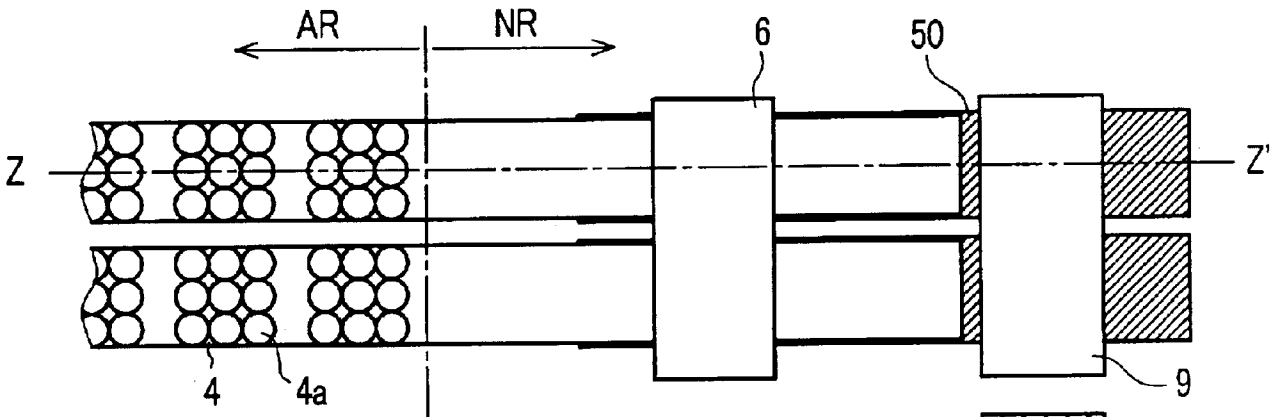
FIG. 1A and FIG. 1B are schematic views showing the constitution of an essential part of a back panel side for explaining the first embodiment of a display device according to the present invention.
Figure 1B:
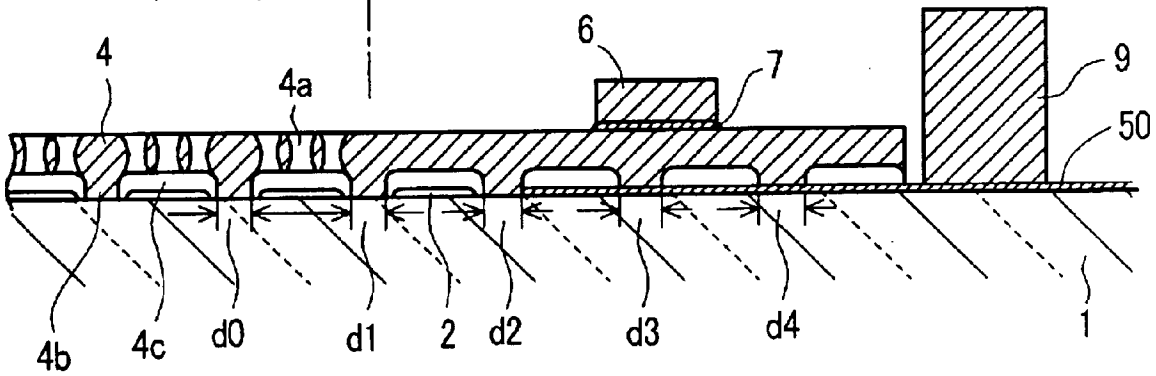
Figure 2:
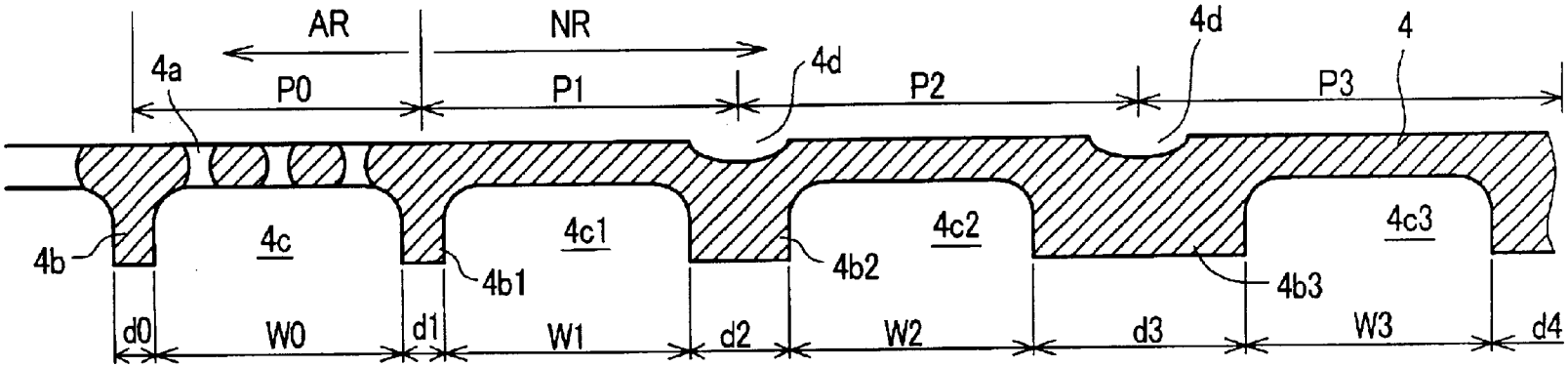
FIG. 2 is a cross-sectional view of an essential part of a plate-like control electrode shown in FIG. 1.

Preferred embodiments of a display device according to the present invention are explained hereinafter in detail in conjunction with attached drawings. FIG. 1A and FIG. 1B are schematic views showing the constitution of an essential part of a back panel side for explaining the first embodiment of a display device according to the present invention, wherein FIG. 1A is a plan view of an essential part as viewed in the back panel direction from a front panel side and FIG. 1B is a cross-sectional view taken along a line Z–Z' in FIG. 1A. Further, FIG. 2 is a cross-sectional view of an essential part of a plate-like control electrode shown in FIG. 1. Numeral 1 indicates a back substrate which constitutes a back panel, numeral 2 indicates cathode lines, numeral 4 indicates plate-like control electrodes, numeral 6 indicates pressing members, numeral 7 indicates an adhesive agent such as frit glass, and numeral 9 indicates a sealing frame. There may be a case in which a fixing portion on which the pressing member 6 is mounted is indicated by numeral 6.

In a display region AR of the plate-like control electrodes 4, electron passing holes 4*a* which allow electrons emitted from electron sources (not shown in the drawing) such as carbon nanotubes of the cathode lines 2 to pass therethrough in the front panel direction are formed. Further, on the back substrate 1 side of the display region AR, protrusions 4*b* are formed so as to prevent a contact between the plate-like control electrodes 4 and the cathode lines 2 by holding a given distance between the plate-like control electrodes 4 and the cathode lines 2. A large-sized recessed portion 4*c* is formed between the protrusion 4*b* and another protrusion 4*b* which is arranged close to the former protrusion 4*b*. Leads (plate-like control electrode leads) 50 for supplying control signals are connected to end portions of the plate-like control electrodes 4 and are pulled out to the outside. The end portions of the plate-like control electrodes 4 and the lead lines 50 may be connected to each other by interposing a conductive paste therebetween.

The plate-like control electrodes 4 are fixed by the pressing members 6 at fixing portions which are positioned at both ends thereof in external non-display regions NR outside the display region AR. The pressing member 6 is made of an insulation material such as a glass material and is connected to the plate-like control electrodes 4 to each other using an adhesive agent 7 which is preferably made of frit glass. The adhesive agent 7 is also filled between the plate-like control electrodes 4 and hence, the plate-like control electrodes 4 are fixed to the back substrate 1. The sealing frame 9 which is arranged outside the pressing members 6 is sandwiched between the back substrate 1 and the front panel not shown in the drawing. It may be possible to interpose a suitable adhesive material such as frit glass similar to the above-mentioned frit glass or epoxy-series resin in a space defined by the sealing frame 9, the back panel (the back substrate 1) and the front panel (the front substrate).

Although the cathode lines 2 are formed in the external non-display region NR in FIG. 1A and FIG. 1B, these cathode lines 2 constitute dummies and hence, they may not be provided depending on cases. The same goes for other embodiments.

As shown in FIG. 2, on the back substrate 1 side of the plate-like control electrode 4, the protrusions 4*b* are formed at positions where the protrusions 4*b* sandwich the electron passing holes 4*a* in the extending direction of the plate-like control electrode 4 (assuming the extending direction of the cathode lines 2 as one direction, another direction which crosses this one direction). The protrusions 4*b* are also formed in the external non-display region NR outside the display region AR. The protrusion which is arranged at a boundary portion between the display region AR and the external non-display region NR is indicated by numeral 4*b*1 and other protrusions which are arranged at the external non-display region NR are indicated by numerals 4*b*2, 4*b*3, . . . in the order away from the display region AR.

Further, the large-sized recessed portion 4*c* is formed between the protrusions 4*b* (4*b*, 4*b*1, 4*b*2, . . . ). These large-sized recessed portions 4*c* are also formed in the external non-display region NR and the large-sized recessed portions arranged in the external non-display region NR are indicated by numerals 4*c*1, 4*c*2, 4*c*3, . . . respectively. Further, indented portions 4*d* are also formed in the external non-display region NR of the plate-like control electrode 4. These indented portions 4*d* are positioned at sides opposite to positions where the protrusions 4*b*2, 4*b*3, . . . are formed. These indented portions 4*d* may be omitted when they are unnecessary. The same goes for embodiments other than this embodiment.

Here, a gap between the neighboring protrusions 4*b* as measured in the extending direction of the plate-like control electrode 4 is assumed as W (a length of the gap within the display region AR is assumed as W0, and a length of the gap within the external non-display region NR is assumed as W1, W2, W3, . . . , Wn), a length of the protrusions 4*b* in the above-mentioned extending direction is assumed d (a length of the protrusions 4*b* within the display region AR is assumed as d0, a length of the protrusion 4*b* in the boundary between the display region AR and the external non-display region NR is assumed as d1, and a length of the protrusions 4*b* within the external non-display region NR is assumed as d2, d3, d4, . . . , dn), and a pitch of the protrusions 4*b* is assumed as P (a pitch of the protrusions 4*b* within the display region AR is assumed as PO and a pitch of the protrusions 4*b* within the external non-display region NR is assumed as P1, P2, P3, . . . , Pn). Here, the indented portions 4*d* are formed in conformity with the pitch P of the protrusions 4*b*.

In the embodiment explained in FIG. 2, following relationships are established among the above-mentioned length W, length d and pitch P.

$$W0=W1=W2=W3=\ldots=Wn$$

$$d0 \leqq d1<d2<d3<\ldots<dn$$

$$P0<P1<P2<P3<\ldots<Pn$$

Figure 18:
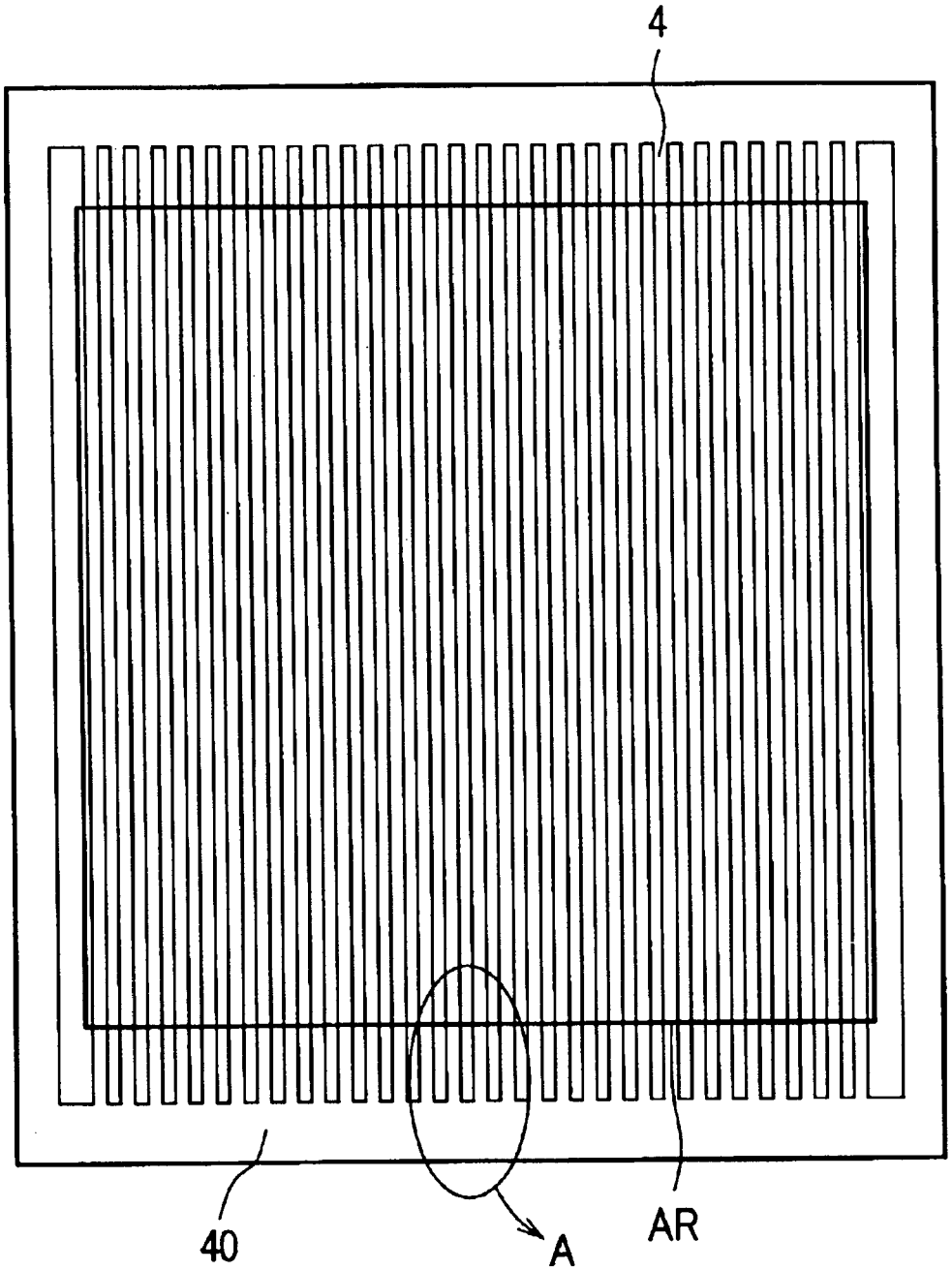
FIG. 18 is a plan view for explaining a shape of plate-like control electrodes as parts before mounting them on a back substrate.

With the use of the plate-like control electrodes 4 having the constitution of this embodiment, the mechanical strength of the plate-like control electrode 4 is gradually increased from the display region AR to the external non-display region NR. Accordingly, in an operational step for mounting the plate-like control electrodes 4 to the back substrate 1, it is possible to reduce the occurrence of cracks, breaking or deformation of the plate-like control electrodes 4 in the vicinity of the boundary between the display region AR and the external non-display region NR, in the vicinity of the fixing portion where the pressing member 6 is mounted or a portion of a frame 40 (see FIG. 18) whereby the operability at the time of assembling is enhanced and the reduction of yield factor of the product is suppressed thus providing a highly reliable display device.

Although one cathode line 2 is arranged between two neighboring protrusions 4*b* within the display region AR in this embodiment, the present invention is not limited to such an arrangement. That is two or more cathode lines 2 may be arranged between two neighboring protrusions 4*b*. The same goes for other embodiments.

Further, in supporting the plate-like control electrodes 4 using the protrusions 4*b*, the protrusions 4*b* may be brought into direct contact with the back substrate 1 or may be brought into indirect contact with the back substrate 1 by interposing an intermediate layer such as an adhesive agent layer or an insulation layer therebetween. The same goes for other embodiments.

Further, although the plate-like control electrodes 4 are fixed only at the fixing portions in the external non-display region NR using the pressing members 6 or the like in this embodiment, the plate-like control electrodes 4 may be fixed using both of this fixing portions and another places within the display region AR such as the protrusion 4*b*, for example. The same goes for other embodiments.

Still further, holes similar to the electron passing holes 4*a* may be formed in portions of the external non-display region NR of the plate-like control electrode 4 when necessary. This constitution gives rise to an advantageous effect that the change of strength between the inside and outside of the display region AR can be reduced. The shape and the arrangement of these holes may be changed when necessary. The same goes for other embodiments.

Figure 3:
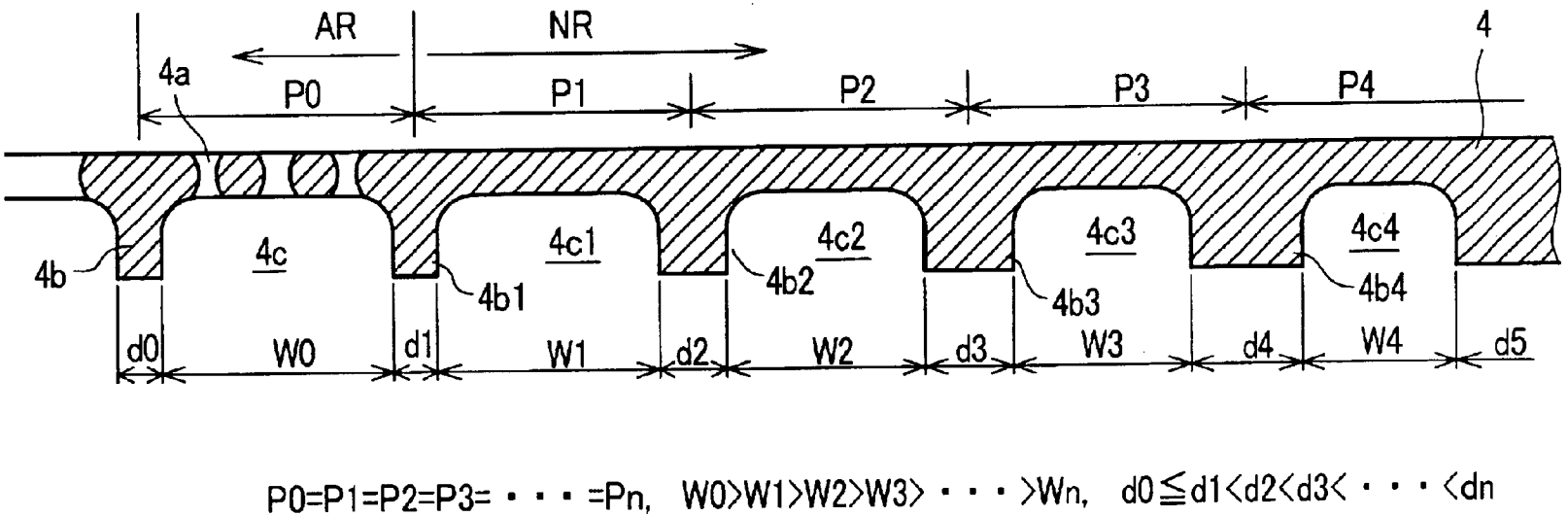
FIG. 3 is a cross-sectional view of an essential part of a plate-like control electrode for explaining the second embodiment of the display device according to the present invention.

FIG. 3 is a cross-sectional view of an essential part of a plate-like control electrode 4 for explaining the second embodiment of the display device according to the present invention. The planar structure and the cross-sectional structure of the mounting structure of the plate-like control electrode 4 shown in FIG. 3 is equal to those structures shown in FIG. 1A and FIG. 1B. Numerals in FIG. 3 which are equal to those in FIG. 2 indicate parts having identical functions. In this embodiment, the display region AR has electron passing holes 4*a* in the same manner as FIG. 2. However, this embodiment differs from the first embodiment in the arrangement of the protrusions 4*b*1, 4*b*2, . . . , 4*b*n in the boundary and the external non-display region NR. In the embodiment, following relationships are established among the above-mentioned length W, length d and pitch P.

$W0>W1>W2>W3>\ldots>Wn$ $d0\leqq d1<d2<d3<\ldots<dn$ $P0=P1=P2=P3=\ldots=Pn$

Further, on the front panel side of the external non-display region NR of the plate-like control electrode 4, indented portions (so-called half-etched portions) similar to those shown in FIG. 2 maybe formed. With the use of the plate-like control electrodes 4 having the constitution of this embodiment, the mechanical strength of the plate-like control electrode 4 is gradually increased from the display region AR to the external non-display region NR. Accordingly, in an operational step for mounting the plate-like control electrodes 4 to the back substrate 1, it is possible to reduce the occurrence of cracks, breaking or deformation of the plate-like control electrodes 4 in the vicinity of the boundary between the display region AR and the external non-display region NR, in the vicinity of the fixing portion where the pressing member 6 is mounted or a portion of the frame 40 (see FIG. 18) whereby the operability at the time of assembling is enhanced and the reduction of yield factor of the product is suppressed thus providing a highly reliable display device.

Figure 4:
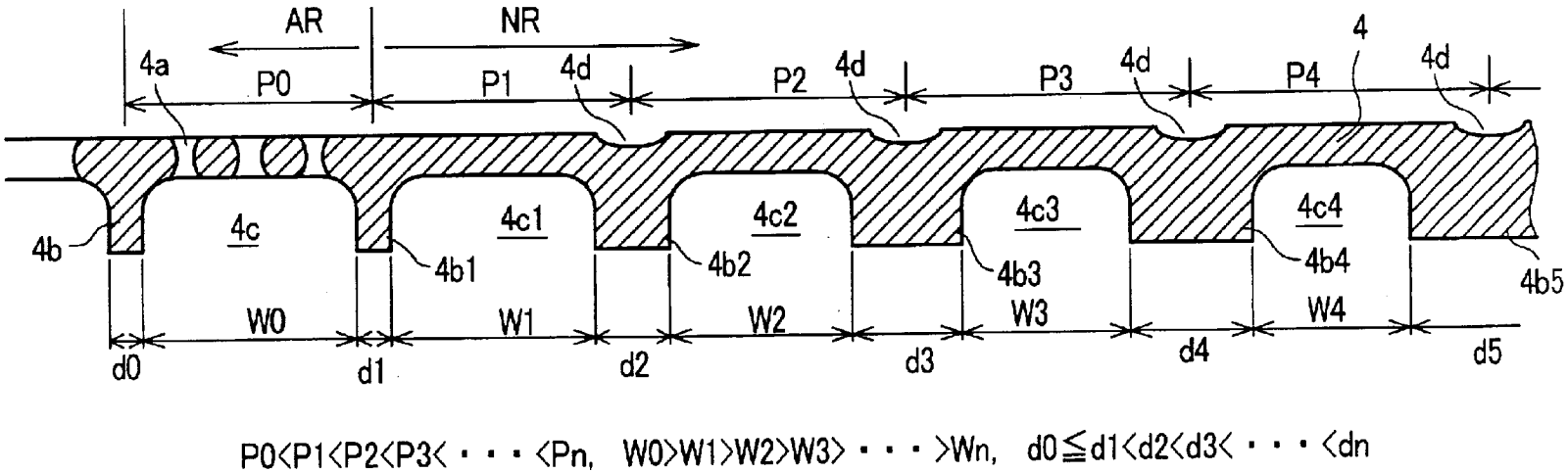
FIG. 4 is a cross-sectional view of an essential part of a plate-like control electrode for explaining the third embodiment of the display device according to the present invention.

FIG. 4 is a cross-sectional view of an essential part of a plate-like control electrode for explaining the third embodiment of the display device according to the present invention. The planar structure and the cross-sectional structure of the mounting structure of the plate-like control electrode 4 shown in FIG. 4 is equal to those structures shown in FIG. 1A and FIG. 1B. Numerals in FIG. 4 which are equal to those in FIG. 3 indicate parts having identical functions. In this embodiment, the display region AR has electron passing holes 4*a* in the same manner as FIG. 3. However, this embodiment differs from the second embodiment in the arrangement of the protrusions 4*b*1, 4*b*2, . . . , 4*bn* in the boundary and the external non-display region NR. In the embodiment, following relationships are established among the above-mentioned length W, length d and pitch P.

$W0>W1>W2>W3>\ldots>Wn$ $d0\leqq d1<d2<d3<\ldots<dn$ $P0<P1<P2<P3<\ldots<Pn$

Further, although indented portions 4*d* are formed on the front panel side of the external non-display region NR of the plate-like control electrode 4, the front panel side of the external non-display region NR may be flattened or leveled as shown in FIG. 3. With the use of the plate-like control electrodes 4 having the constitution of this embodiment, the mechanical strength of the plate-like control electrode 4 is gradually increased from the display region AR to the external non-display region NR. Accordingly, in an operational step for mounting the plate-like control electrodes 4 to the back substrate 1, it is possible to reduce the occurrence of cracks, breaking or deformation of the plate-like control electrodes 4 in the vicinity of the boundary between the display region AR and the external non-display region NR, in the vicinity of the fixing portion where the pressing member 6 is mounted whereby the operability at the time of assembling is enhanced and the reduction of yield factor of the product is suppressed thus providing a highly reliable display device.

In the above-mentioned first to third embodiments, the explanation has been made by assuming that the relationship among the variable factors among the length W, the length d and pitch P is linearly changed. However, it is possible to arrange them such that the relationship is non-linearly changed or gently curved.

With respect to the relationship among the length W, the length d and the pitch P, the values which are expressed as equal (=) do not necessarily mean that they are completely equal and it is sufficient if they are substantially equal.

Further, it is not always necessary to increase the mechanical strength of the plate-like control electrode 4 over the whole area of the external non-display region NR. That is, it may be sufficient to gradually increase the mechanical strength of the plate-like control electrode 4 in at least a portion of the external non-display region NR. For example, a portion of the external non-display region NR which is close to the display region AR has the substantially same shape as that of the display region AR and the mechanical strength is increased from an intermediate portion of the external non-display region NR.

Further, it is not always necessary to change these values for every protrusion 4*b* and the concept of the increasing of the mechanical strength includes a case that the values may be changed every two or more protrusion 4*b*. For example, the pitch P can be set to a following relationship $P0<P1=P2<P3=P4<\ldots Pn$. Further, since the equal symbol does not require the strict equality, the relationship $P1>P2$ is allowed provided that the difference is small.

Further, in place of the gradual increase of the mechanical strength, it may be possible to make the display region AR and the external non-display region NR have the substantially the same shape. Also in this case, it is possible to eliminate the sharp change of the mechanical strength. Particularly, by forming holes similar to the electron passing holes 4*a* in the external non-display region NR, it is further possible to eliminate the change of the mechanical strength.

Further, the plate-like control electrode 4 may have the same shape or a shape which gradually increases at least in a portion thereof up to the fixing portion and have a shape which gradually increases the strength at least in a portion which comes after the fixing portion. With such a provision, it is possible to prevent the breaking of the plate-like control electrode 4 at the portion thereof corresponding to the frame 40 shown in FIG. 18.

Figure 5A:
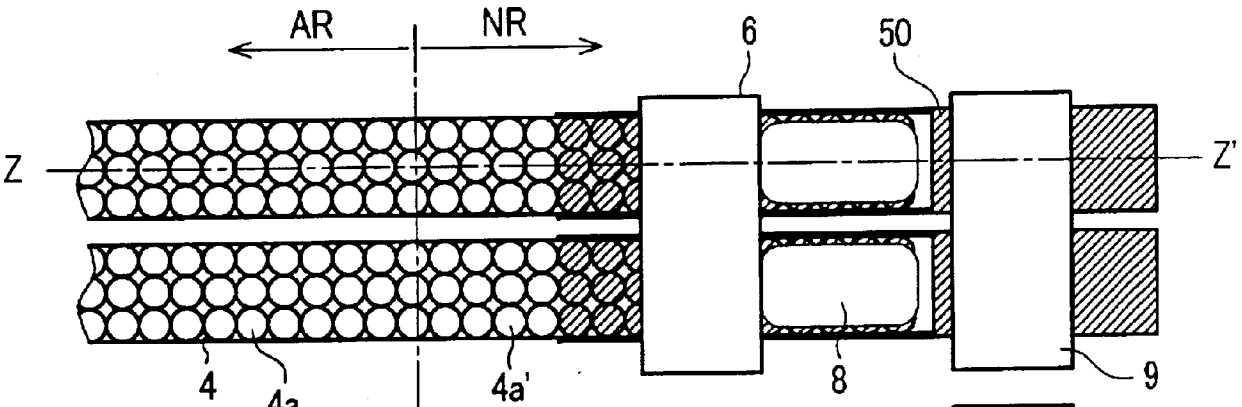
FIG. 5A and FIG. 5B are schematic views of the constitution of an essential part of a back panel side for explaining the fourth embodiment of the display device according to the present invention.
Figure 5B:
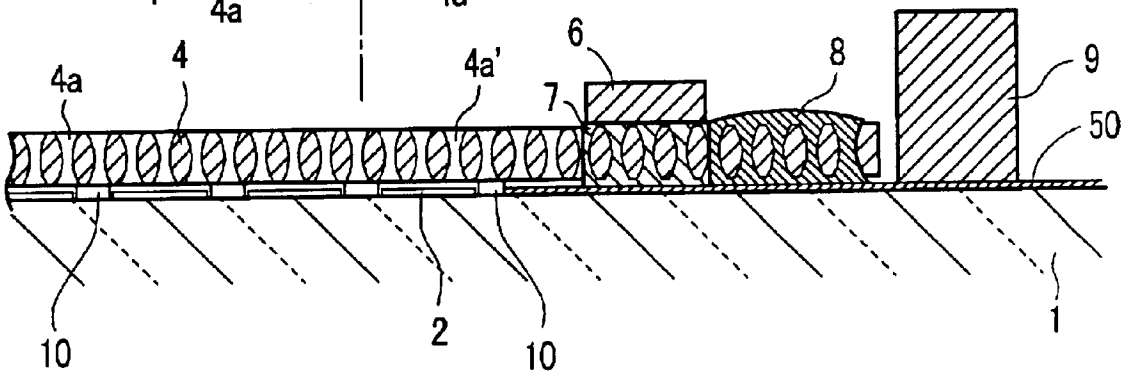
Figures 6A, 6B:
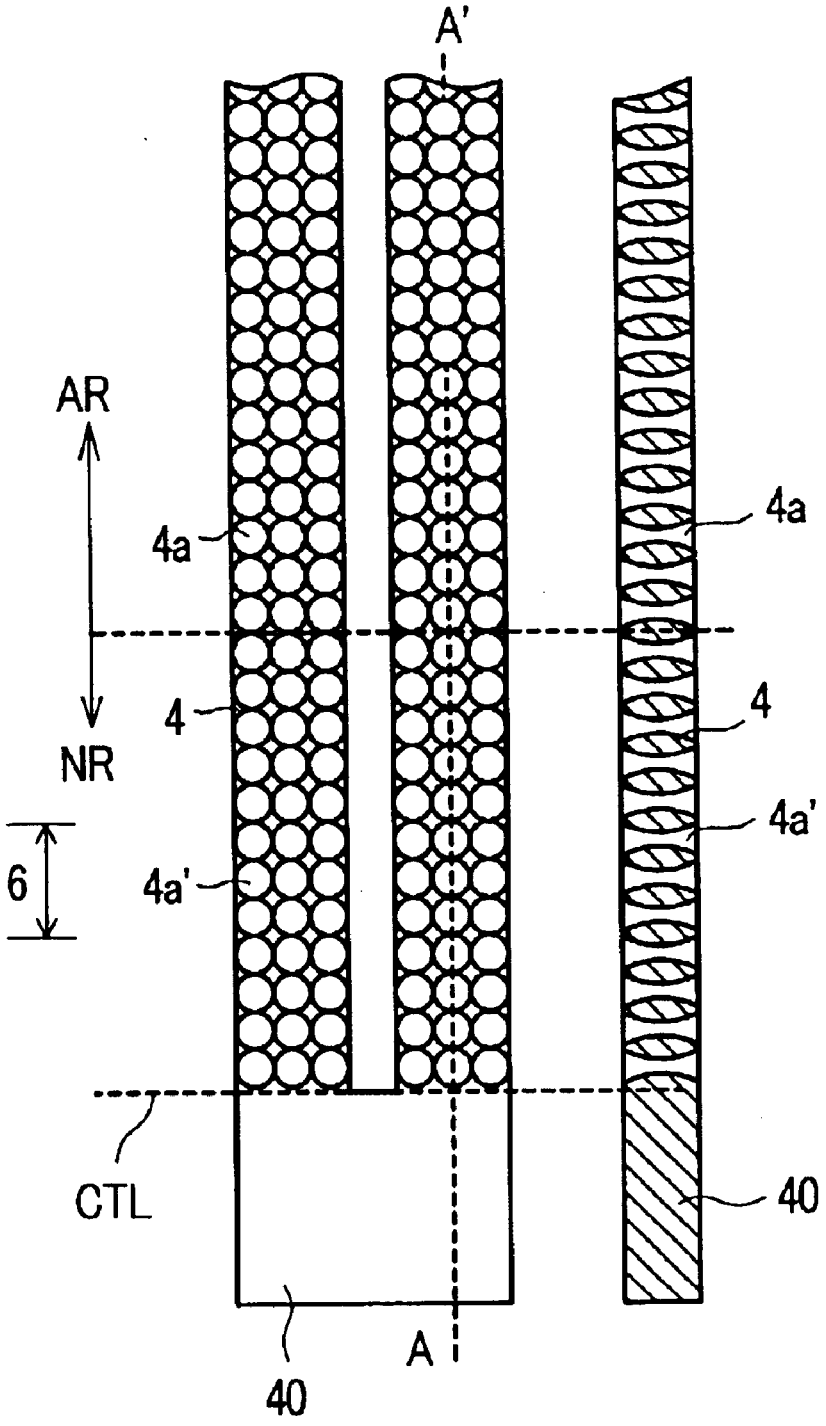
FIG. 6A and FIG. 6B are explanatory views of an essential part of a plate-like control electrode shown in FIG. 5A and FIG. 5B which corresponds to a portion A in FIG. 18.

FIG. 5A and FIG. 5B are schematic views showing the constitution of an essential part of a back panel side for explaining the fourth embodiment of a display device according to the present invention, wherein FIG. 5A is a plan view of an essential part as viewed in the back panel direction from a front panel side and FIG. 5B is a cross-sectional view taken along a line Z–Z' in FIG. 5A. Further, FIG. 6A and FIG. 6B are explanatory views of an essential part of plate-like control electrodes at FIG. 5A and FIG. 5B corresponding to a portion A in FIG. 18, wherein FIG. 6A is a plan view and FIG. 6B is a cross-sectional view taken along a line A–A' in FIG. 6A. In these drawings, numeral 1 indicates a back substrate, numeral 2 indicates cathode lines, numeral 4 indicates plate-like control electrodes, numeral 6 indicates pressing members, numeral 7 indicates an adhesive agent such as frit glass, for example, numeral 8 indicates a conductive paste, numeral 9 indicates a sealing frame, and numeral 10 indicates an insulation layer.

Electron passing holes 4*a* which allow electrons emitted from electron sources (not shown in the drawing) of the cathode lines 2 to pass therethrough toward the front panel direction are formed in a display region AR of the plate-like control electrode 4. Further, holes 4*a*' similar to the electron passing holes 4*a* are formed in a whole area of an external non-display region NR of the plate-like control electrode 4 including a fixing portion. On a back substrate 1 side of the display region AR, the insulation layers 10 which hold a given distance between the plate-like control electrode 4 and the cathode lines 2 are formed so as to prevent the plate-like control electrode 4 and the cathode lines 2 from being in contact with each other. Leads (plate-like control electrode leads) 50 for supplying control signals are connected to end portions of the plate-like control electrodes 4 and are pulled out to the outside. Here, although the connection is performed using the conductive pastes 8, the connection is not limited to such materials.

The plate-like control electrodes 4 are fixed by the pressing members 6 in fixing portions which are positioned at both ends thereof in the external non-display regions NR outside the display region AR. The pressing member 6 is made of an insulation material such as a glass material and is connected to the plate-like control electrodes 4 using the adhesive agent 7 which is preferably made of frit glass. The adhesive agent 7 is also filled between the plate-like control electrodes 4 and hence, the plate-like control electrodes 4 are fixed to the back substrate 1. The adhesive agent 7 reaches the back substrate 1 side through the holes 4*a*'. The sealing frame 9 which is arranged outside the pressing member 6 is sandwiched between the back substrate 1 and the front panel not shown in the drawing. It may be possible to interpose a suitable adhesive material such as frit glass similar to the above-mentioned frit glass or epoxy-series resin in a space defined by the sealing frame 9, the back panel (the back substrate 1) and the front panel (the front substrate). In this embodiment, although the dummy cathode lines 2 are arranged in the external non-display region NR, these dummy cathode lines 2 may not be arranged depending on cases.

In this embodiment, the plate-like control electrode 4 has the same hole opening pattern over the display region AR and the external non-display region NR and hence, the mechanical stress concentration is not generated between the display region AR and the external non-display region NR. Accordingly, compared to a case in which the electron passing holes 4*a* are formed only in the display region AR, in an operational step for mounting the plate-like control electrodes 4 to the back substrate 1, it is possible to reduce the occurrence of cracks, breaking or deformation of the plate-like control electrodes 4 in the vicinity of the boundary between the display region AR and the external non-display region NR or at the fixing portion where the pressing member 6 is mounted whereby the operability at the time of assembling is enhanced and the reduction of yield factor of the product is suppressed thus providing a highly reliable display device. Here, it is not always necessary that the hole opening pattern of the display region AR is equal to the hole opening pattern of the external non-display region NR and it is sufficient when the display region AR and the external non-display region NR adopt patterns which are substantially equal. The plate-like control electrodes 4 are cut and removed from the frame 40 along a cut line CTL.

Figure 7:
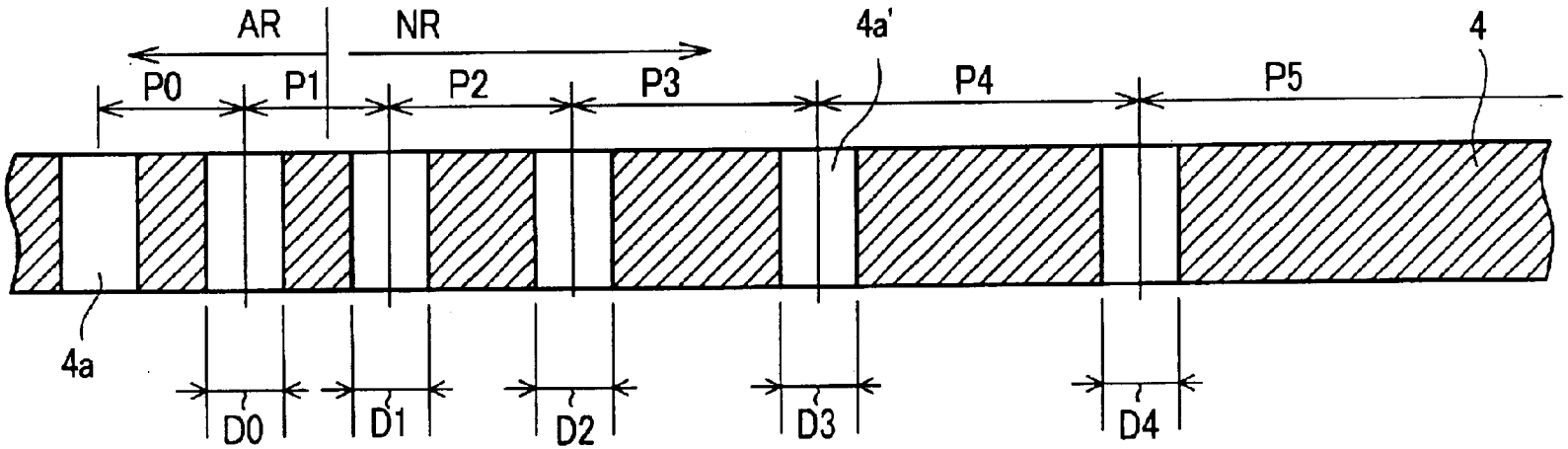
FIG. 7 is a cross-sectional view of an essential part of a plate-like control electrode for explaining the fifth embodiment of the display device according to the present invention.

FIG. 7 is a cross-sectional view of an essential part of a plate-like control electrode for explaining the fifth embodiment of the display device according to the present invention. The planar structure and the cross-sectional structure of the mounting structure of the plate-like control electrode 4 shown in FIG. 7 is equal to those structures shown in FIG. 5A and FIG. 5B. Numerals in FIG. 7 which are equal to those in FIG. 5A and FIG. 5B as well as in FIG. 6A and FIG. 6B indicate parts having identical functions. Electron passing holes 4*a* which allow electrons emitted from electron sources (not shown in the drawing) of the cathode lines 2 to pass therethrough toward the front panel direction are formed in a display region AR of the plate-like control electrode 4. Further, holes 4*a*' similar to the electron passing holes 4*a* are formed in a whole area of an external non-display region NR of the plate-like control electrode 4 including a fixing portion.

In this embodiment, the holes 4*a*' which are formed in the whole area (it is not always necessary to cover the whole area) of the external non-display region NR including the fixing portion (however, it is not always necessary to include the fixing portion) are substantially equal to the electron passing holes 4*a* formed in the display region AR, wherein a pitch P of the holes 4*a*' is gradually increased in the extending direction of the plate-like control electrode 4. That is, assuming a hole diameter of the electron passing holes 4*a* formed in the display region AR as D0, hole diameters of holes 4*a*' formed in the external non-display region NR as D1, D2, . . . Dn, the pitch of the electron passing holes 4*a* formed in the display region AR as P0, the pitch between the electron passing hole 4*a* and the hole 4*a*' in a boundary between the display region AR and the external non-display region NR as P1, and the pitches between the holes 4*a*' formed in the external non-display region NR toward the outside as P2, P3, . . . Pn, following relationships are established.

$$D0=D1=D2=D3=\ldots=Dn$$

$$P0 \leqq P1<P2<P3<\ldots<Pn$$

Further, the indented portions 4*d* shown in FIG. 2 or FIG. 4 or the like may be formed between holes 4*a*' in the external non-display region NR. With the use of the plate-like control electrodes 4 having the constitution of this embodiment, the mechanical strength of the plate-like control electrode 4 is gradually increased from the display region AR to the external non-display region NR. Accordingly, in an operational step for mounting the plate-like control electrodes 4 to the back substrate 1, it is possible to reduce the occurrence of cracks, breaking or deformation of the plate-like control electrodes 4 in the vicinity of the boundary between the display region AR and the external non-display region NR, in the vicinity of the fixing portion where the pressing member 6 is mounted or a portion of a frame 40 whereby the operability at the time of assembling is enhanced and the reduction of yield factor of the product is suppressed thus providing a highly reliable display device.

Figure 8:
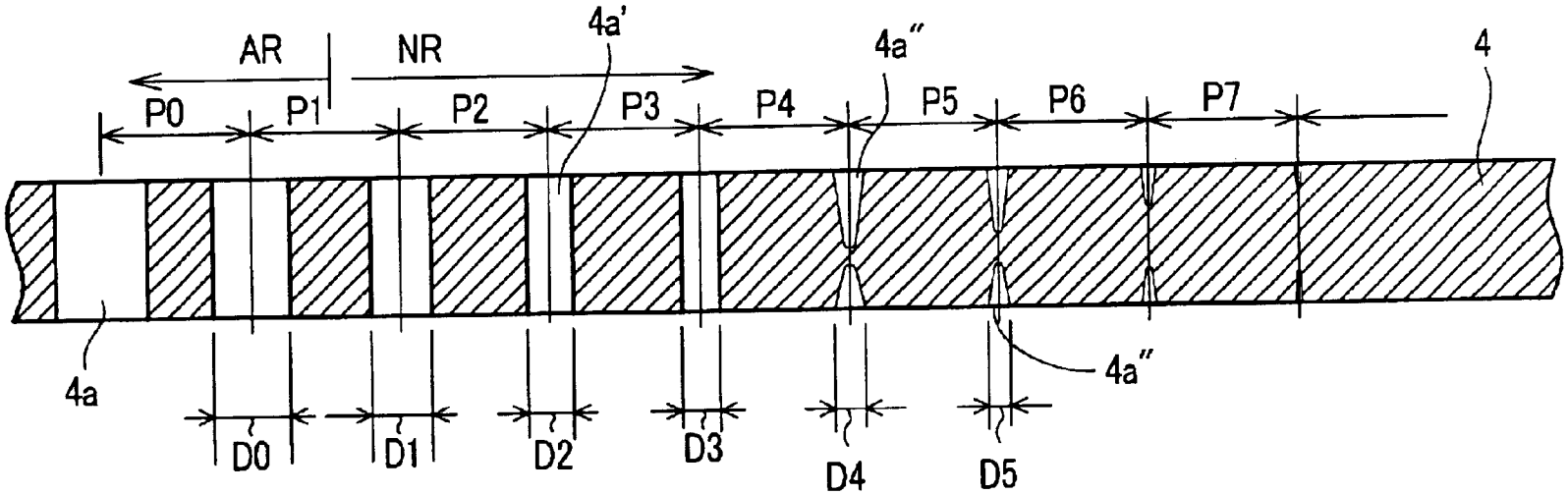
FIG. 8 is a cross-sectional view of an essential part of a plate-like control electrode for explaining the sixth embodiment of the display device according to the present invention.

FIG. 8 is a cross-sectional view of an essential part of a plate-like control electrode for explaining the sixth embodiment of the display device according to the present invention. The planar structure and the cross-sectional structure of the mounting structure of the plate-like control electrode 4 shown in FIG. 8 is equal to those structures shown in FIG. 5A and FIG. 5B. Numerals in FIG. 8 which are equal to those in FIG. 7 indicate parts having identical functions. Electron passing holes 4*a* which allow electrons emitted from electron sources (not shown in the drawing) of the cathode lines 2 to pass therethrough toward the front panel direction are formed in a display region AR of the plate-like control electrode 4. Further, holes 4*a*' similar to the electron passing holes 4*a* are formed in an external non-display region NR of the plate-like control electrode 4. Further, between the hole 4*a*' and an end portion side of the plate-like control electrode 4, non-penetrating recessed portions 4*a*" which gradually decrease diameters thereof in the direction toward the end portion side are formed. These non-penetrating recessed portions 4*a*" are formed as a result of etching.

In this embodiment, a pitch between the electron passing holes 4*a*, a pitch between the holes 4*a*' and a pitch between the non-penetrating recessed portions 4*a*" in the extending direction of the plate-like control electrodes 4 are equal. Further, assuming a hole diameter of the electron passing holes 4*a* formed in the display region AR as D0, hole diameters of the holes 4*a*' and diameters of the non-penetrating recessed portions 4*a*" formed in the external non-display region NR as D1, D2, . . . Dn, the pitch of the electron passing holes 4*a* formed in the display region AR as P0, the pitches between the electron passing hole 4*a*, the hole 4*a*' and the non-penetrating recessed portions 4*a*" in a range extending from the display region AR to the external non-display region NR as P1 (boundary portion), P2, P3, . . . Pn, following relationships are established.

$$D0>D1>D2>D3>\ldots>Dn$$

$$P0=P1=P2=P3=\ldots=Pn$$

With the use of the plate-like control electrodes 4 having the constitution of this embodiment, the mechanical strength of the plate-like control electrode 4 is gradually increased from the display region AR to the external non-display region NR. Accordingly, in an operational step for mounting the plate-like control electrodes 4 to the back substrate 1, it is possible to reduce the occurrence of cracks, breaking or deformation of the plate-like control electrodes 4 in the vicinity of the boundary between the display region AR and the external non-display region NR, at the fixing portion where the pressing member 6 is mounted or at a portion of a frame 40 whereby the operability at the time of assembling is enhanced and the reduction of yield factor of the product is suppressed thus providing a highly reliable display device.

Figure 9:
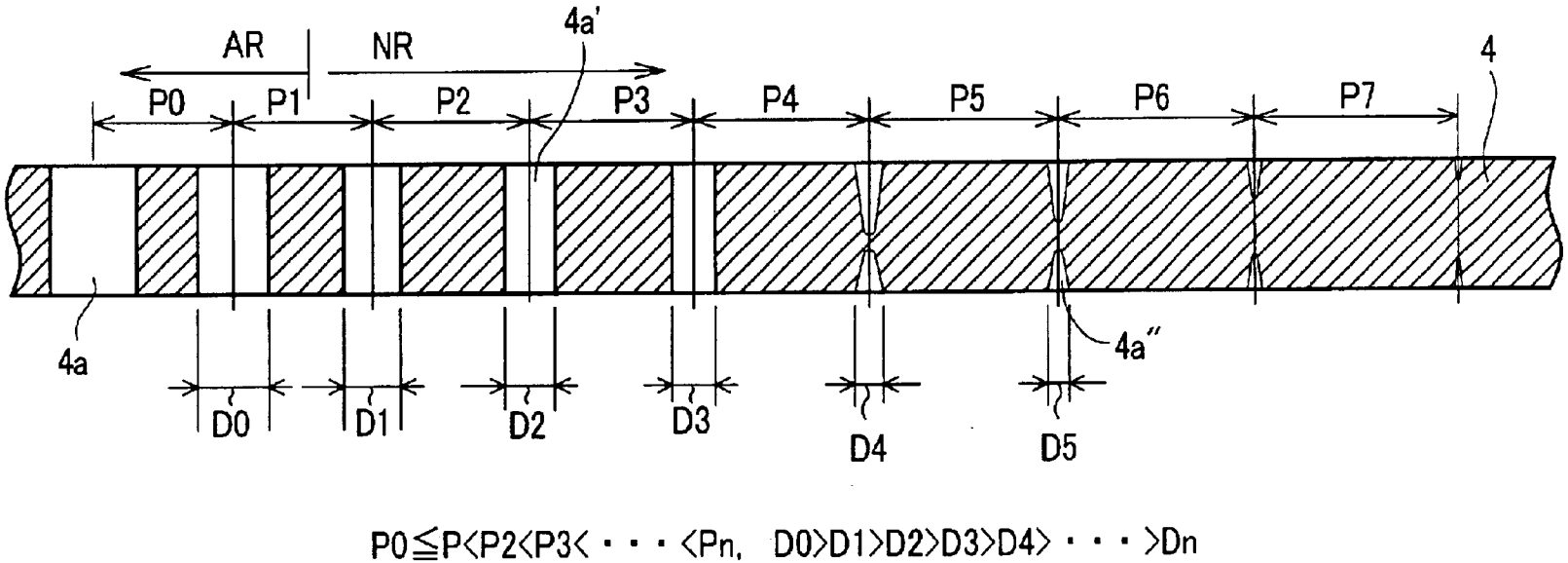
FIG. 9 is a cross-sectional view of an essential part of a plate-like control electrode for explaining the seventh embodiment of the display device according to the present invention.

FIG. 9 is a cross-sectional view of an essential part of a plate-like control electrode 4 for explaining the seventh embodiment of the display device according to the present invention. The planar structure and the cross-sectional structure of the mounting structure of the plate-like control electrode 4 shown in FIG. 9 are equal to those structures shown in FIG. 5A and FIG. 5B. Numerals in FIG. 9 which are equal to those in FIG. 7 and FIG. 8 indicate parts having identical functions. Electron passing holes 4*a* which allow electrons emitted from electron sources (not shown in the drawing) of the cathode lines 2 to pass therethrough toward the front panel direction are formed in a display region AR of the plate-like control electrode 4. Further, holes 4*a*' similar to the electron passing holes 4*a* are formed in an external non-display region NR of the plate-like control electrode 4. Further, in the same manner as the sixth embodiment, from the hole 4*a*' to an end portion side of the plate-like control electrode 4, non-penetrating recessed portions 4*a*" which gradually decrease diameters thereof in the direction toward the end portion side are formed.

In this embodiment, a pitch between the holes 4*a*' and a pitch between the non-penetrating recessed portions 4*a*" in the external non-display region NR are gradually increased than a pitch between the electron passing holes 4*a* in the display region AR in the extending direction of the plate-like control electrode 4. Further, assuming a hole diameter of the electron passing holes 4*a* formed in the display region AR as D0, hole diameters of the holes 4*a*' and diameters of the non-penetrating recessed portions 4*a*" formed in the external non-display region NR as D1, D2, . . . Dn, the pitch of the electron passing holes 4*a* formed in the display region AR as P0, the pitches between the electron passing hole 4*a*, the hole 4*a*' and the non-penetrating recessed portions 4*a*" in a range extending from the display region AR to the external non-display region NR as P1 (boundary portion), P2, P3, . . . Pn, following relationships are established.

$$D0>D1>D2>D3>\ldots>Dn$$

$$P0\leqq P1<P2<P3<\ldots<Pn$$

With the use of the plate-like control electrodes 4 having the constitution of this embodiment, the mechanical strength of the plate-like control electrode 4 is gradually increased from the display region AR to the external non-display region NR. Accordingly, in an operational step for mounting the plate-like control electrodes 4 to the back substrate 1, it is possible to reduce the occurrence of cracks, breaking or deformation of the plate-like control electrodes 4 in the vicinity of the boundary between the display region AR and the external non-display region NR, in the vicinity of the fixing portion where the pressing member 6 is mounted or in the vicinity of a portion of a frame 40 whereby the operability at the time of assembling is enhanced and the reduction of yield factor of the product is suppressed thus providing a highly reliable display device.

Figure 10:
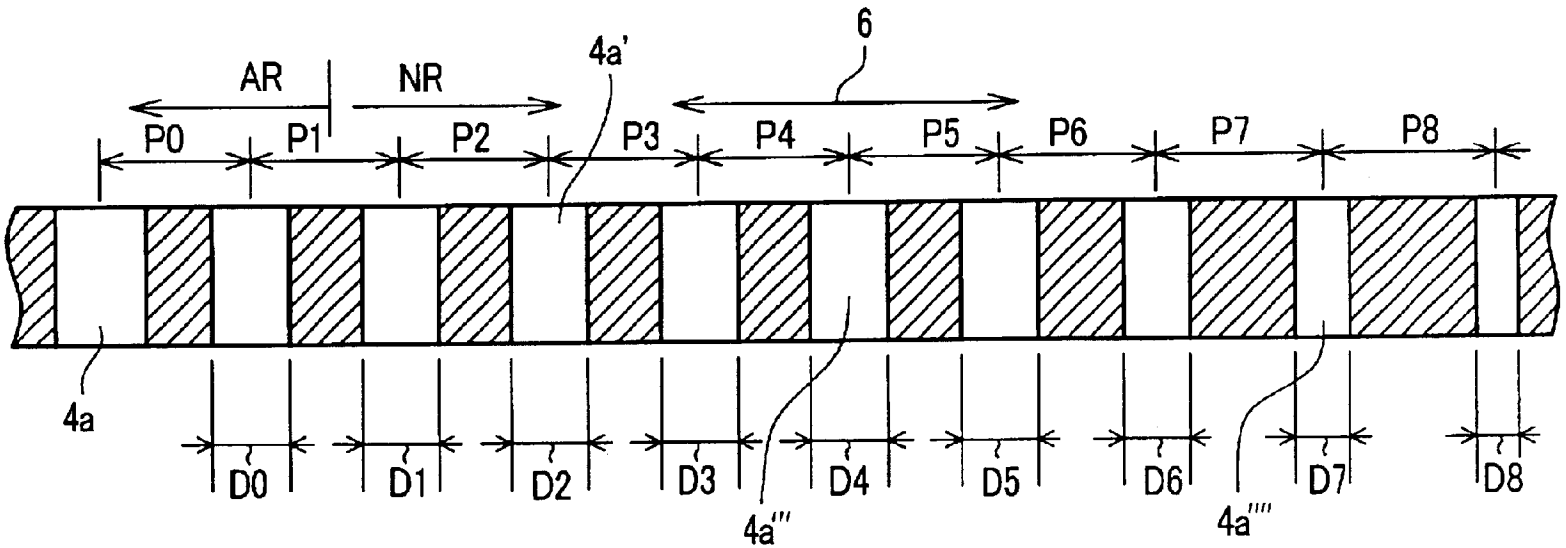
FIG. 10 is a cross-sectional view of an essential part of a plate-like control electrode for explaining the eighth embodiment of the display device according to the present invention.

FIG. 10 is a cross-sectional view of an essential part of a plate-like control electrode for explaining the eighth embodiment of the display device according to the present invention. The planar structure and the cross-sectional structure of the mounting structure of the plate-like control electrode 4 shown in FIG. 10 are equal to those structures shown in FIG. 5A and FIG. 5B. Numerals in FIG. 10 which are equal to those in FIG. 7 to FIG. 9 indicate parts having identical functions. In this embodiment, a pitch P0 and a hole diameter D0 of electron passing holes 4*a* formed in a display region AR, pitches P1 to P3 (P1 being the pitch in a boundary) and hole diameters D1 to D2 in a range from the display region AR to a fixing portion (shown by an arrow in the drawing) of an external non-display region NR where a pressing member 6 is formed, pitches P4, P5 and hole diameters D3 to D5 of holes 4*a*"' in the fixing portion, and pitches P6 to Pn and hole diameters D6, D7, . . . , Dn of holes 4*a*"" formed in the end portion side outside the fixing portion are set to have following relationships.

$$D0=D1=D2\geqq D3\geqq D4\geqq D5>D6>D7>D8>\ldots>Dn$$

$$P0=P1=P2=P3\leqq P4\leqq P5<P6<P7<P8<\ldots<Pn$$

With the use of the plate-like control electrodes 4 having the constitution of this embodiment, the mechanical strength of the plate-like control electrode 4 is held equal in a range extending from the display region AR to the fixing portion of the external non-display region NR and is increased from the fixing portion to the end portion. The mechanical strength may not be changed within the fixing portion. Accordingly, in an operational step for mounting the plate-like control electrodes 4 to the back substrate 1, since the strength of a connection portion with the frame 40 (see FIG. 18) on which a stress attributed to an external force is concentrated is particularly strong, it is possible to reduce the occurrence of cracks, breaking or deformation of the portion whereby the operability at the time of assembling is enhanced and the reduction of yield factor of the product is suppressed. Further, since the hole pattern is held equal in the range extending from the display region AR to the fixing portion of the external non-display region NR, the occurrence of cracks, breaking or deformation of the plate-like control electrode 4 between the display region AR and the fixing portion of the external non-display region NR due to the thermal expansion at the time of operation after becoming a part of a product can be reduced whereby it is possible to provide a highly reliable display device.

Here, some of the holes 4*a*"" which come after the intermediate portion of the external non-display regions NR may be formed of non-penetrating recessed portions. Further, it is not always necessary to change the strength of the plate-like control electrode 4 immediately behind the fixing portion.

With respect to the fourth to the eighth embodiments which have been explained heretofore, the changes of the pitch P and the length D may be either linear or nonlinear.

Further, with respect to the pitch P and D, the values which are expressed as equal (=) in the drawing do not necessarily mean that they are completely equal and it is sufficient if they are substantially equal.

Further, it is not always necessary to gradually change the strength of the plate-like control electrode 4 over the whole region of the external non-display region NR and the strength may be gradually changed over at least a portion of the external non-display region NR. For example, a portion of the external non-display region NR which is close to the display region AR may have substantially the same shape as the display region AR and the shape of the external non-display region NR may be changed thereafter.

Further, it is not always necessary to change the values every pitch P or every length D and the concept of increasing the mechanical strength includes a case that the values may be changed every two or more pitches or lengths. For example, the pitches can be set to a following relationship $P0 \leqq P1=P2<P3=P4<\ldots Pn$. Further, since the equal symbol (=) does not require the strict equality, the relationship $P1>P2$ is allowed provided that the difference is small.

Figures 11A, 11B:
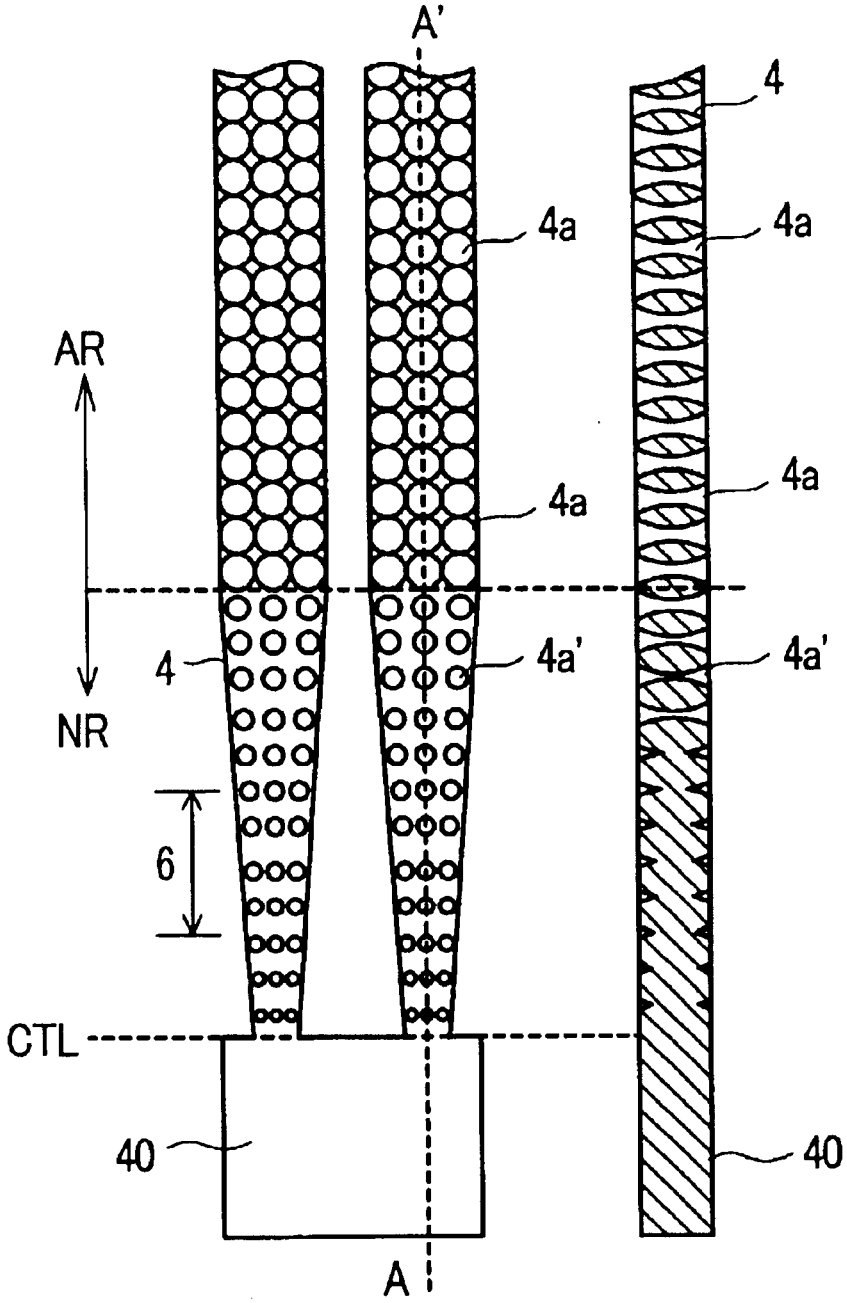
FIG. 11A and FIG. 11B are schematic views of the constitution of an essential part of a plate-like control electrode for explaining the ninth embodiment of the display device according to the present invention.

FIG. 11A to FIG. 11B are schematic views of the constitution of an essential part of a plate-like control electrode for explaining the ninth embodiment of the display device according to the present invention. FIG. 11A is a plan view of an essential part as viewed in the back panel direction from a front panel side and FIG. 11B is a cross-sectional view taken along a line A–A' in FIG. 11A. The planar structure and the cross-sectional structure of the mounting structure of the plate-like control electrode 4 shown in FIG. 11A and FIG. 11B are equal to those structures shown in FIG. 5A and FIG. 5B. Further, numerals in FIG. 11A and FIG. 11B which are equal to those in FIG. 5A and FIG. 5B indicate parts having identical functions. In this embodiment, a width of the plate-like control electrode 4 is gradually narrowed from a boundary between a display region AR and an external non-display region NR to the external non-display region NR and holes 4*a*' which gradually decrease hole diameters thereof are formed in the external non-display region NR.

In this embodiment, in order to make the external non-display region NR of the plate-like control electrode 4 have the substantially equal mechanical strength or gradually increase the mechanical strength, the hole diameters of the holes 4*a*' are gradually made smaller. Here, there may be a case that as the holes 4*a* approach an end portion of the plate-like control electrode 4, some holes 4*a*' are formed into non-penetrating holes. These holes 4*a*' are formed as a result of the above-mentioned etching. The degree of increase of such a mechanical strength can be adjusted by gradually narrowing the width of the plate-like control electrode 4 in the direction toward the end portion. By narrowing the width, it is possible to easily fill a sufficient quantity of an adhesive agent 7 in a fixing portion so as to increase the fixing strength.

With the use of the plate-like control electrode 4 having the constitution of this embodiment, there is no possibility that the mechanical strength of the plate-like control electrode 4 is sharply changed in the vicinity of the boundary between the display region AR and the external non-display region NR. Accordingly, in an operational step for mounting the plate-like control electrodes 4 to the back substrate 1, it is possible to reduce the occurrence of cracks, breaking or deformation of the plate-like control electrodes 4 in the vicinity of the above-mentioned boundary and the portion of a frame 40, whereby the operability at the time of assembling is enhanced and the reduction of yield factor of the product is suppressed, and the occurrence of cracks, breaking or deformation of the plate-like control electrode 4 which may be caused by the thermal expansion at the time of operation after becoming a part of a product can be reduced thus providing a highly reliable display device.

Figures 12A, 12B:
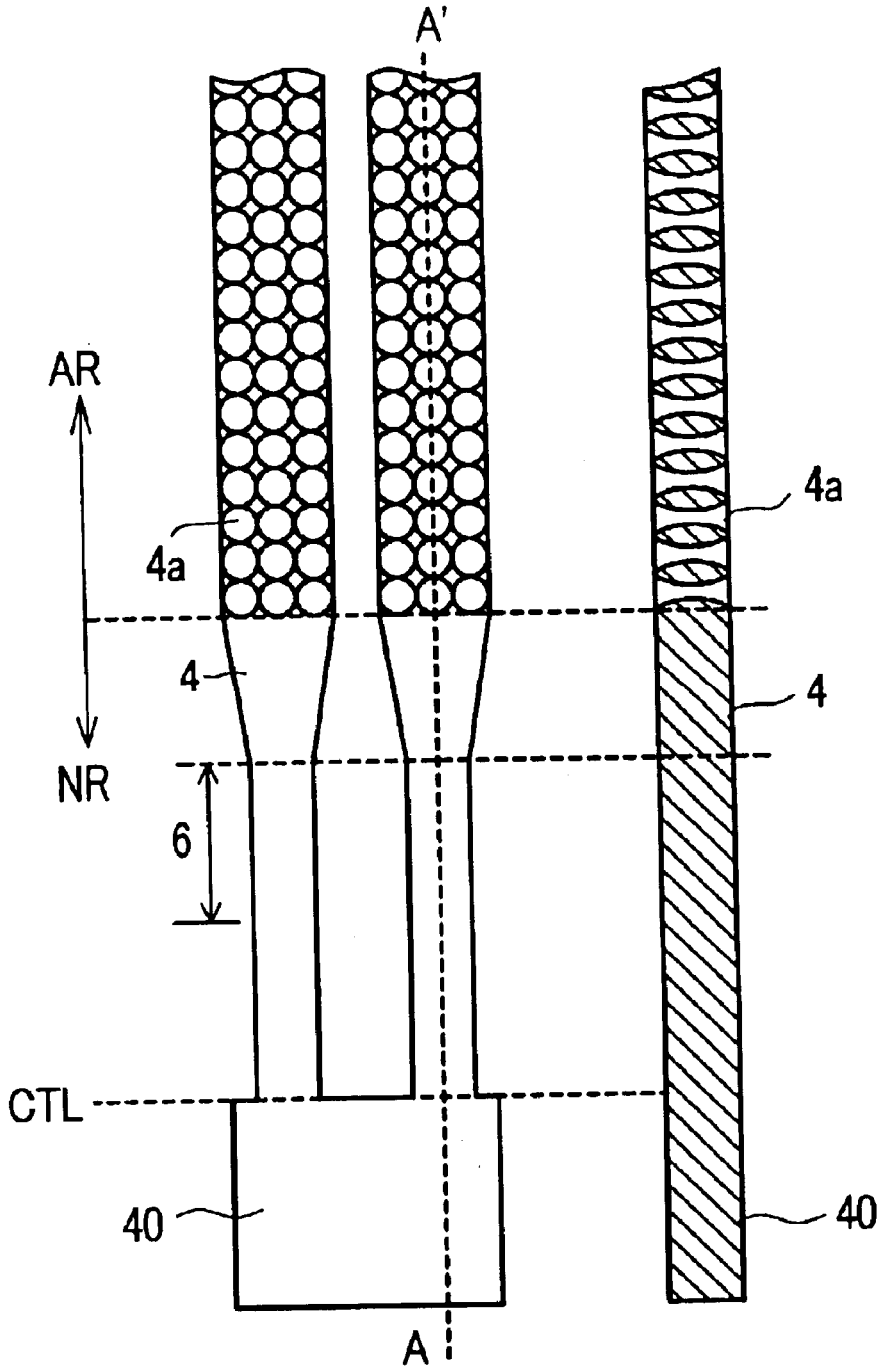
FIG. 12A and FIG. 12B are schematic views of the constitution of an essential part of a plate-like control electrode for explaining the tenth embodiment of the display device according to the present invention.

FIG. 12A to FIG. 12B are schematic views of the constitution of an essential part of a plate-like control electrode for explaining the tenth embodiment of the display device according to the present invention. FIG. 12A is a plan view of an essential part as viewed in the back panel direction from a front panel side and FIG. 12B is a cross-sectional view taken along a line A–A' in FIG. 12A. The planar structure and the cross-sectional structure of the mounting structure of the plate-like control electrode 4 shown in FIG. 12A and FIG. 12B is equal to the structure shown in FIG. 5A and FIG. 5B. Further, numerals in FIG. 12A and FIG. 12B which are equal to those in FIG. 5A and FIG. 5B indicate parts having identical functions. In this embodiment, a width of the plate-like control electrode 4 is gradually narrowed from a boundary between a display region AR and an external non-display region NR to a fixing portion of the external non-display region NR where a pressing member is mounted and the width of the plate-like control electrode 4 from the fixing portion to an end portion is set equal.

Holes 4*a*' and non-penetrating recessed portions 4*a*" may be formed in the external non-display region NR when necessary. Further, the pitches and diameters of these holes 4*a* and non-penetrating recessed portions 4*a*" may be changed.

In this embodiment, the mechanical strength of the plate-like control electrode 4 is gradually reduced by gradually narrowing the width of the plate-like control electrode 4 from the display region AR to the fixing portion of the external non-display region NR. Further, the width of the plate-like control electrode 4 is held equal from the fixing potion to the end portion. The fixing portion is a region where the pressing member is mounted and is indicated by the same numeral 6 as the pressing member. Further, it is also possible to make a sealing frame 9 have the function of the pressing member. Since the width of the plate-like control electrode 4 is set narrow in the fixing portion compared to the display region AR, it is easy to fill an adhesive agent 7.

With the use of the plate-like control electrode 4 having the constitution of this embodiment, there is no possibility that the mechanical strength of the plate-like control electrode 4 is sharply changed in the vicinity of the boundary between the display region AR and the external non-display region NR. Accordingly, in an operational step for mounting the plate-like control electrodes 4 to the back substrate 1, it is possible to reduce the occurrence of cracks, breaking or deformation of the plate-like control electrodes 4 in the vicinity of the above-mentioned boundary portion whereby the operability at the time of assembling is enhanced and the reduction of yield factor of the product is suppressed, and the occurrence of cracks, breaking or deformation of the plate-like control electrode 4 which may be caused by the thermal expansion at the time of operation after becoming a part of a product can be reduced thus providing a highly reliable display device.

Figures 13A, 13B:
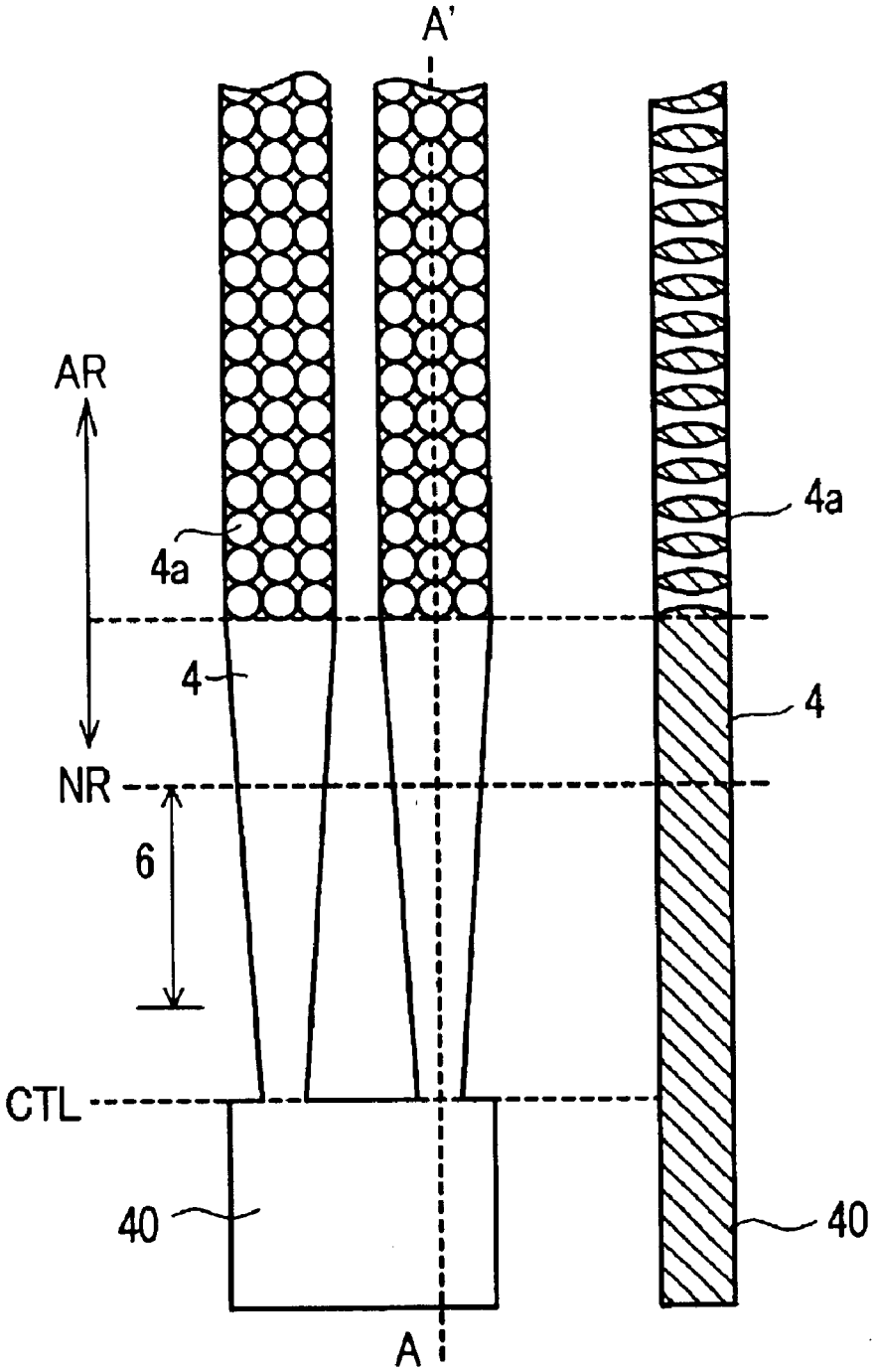
FIG. 13A and FIG. 13B are schematic views of the constitution of an essential part of a plate-like control electrode for explaining the eleventh embodiment of the display device according to the present invention.

FIG. 13A to FIG. 13B are schematic views of the constitution of an essential part of a plate-like control electrode for explaining the eleventh embodiment of the display device according to the present invention. FIG. 13A is a plan view of an essential part as viewed in the back panel direction from a front panel side and FIG. 13B is a cross-sectional view taken along a line A–A' in FIG. 13A. The planar structure and the cross-sectional structure of the mounting structure of the plate-like control electrode 4 shown in FIG. 13A and FIG. 13B are equal to the structure shown in FIG. 5A and FIG. 5B. Further, numerals in FIG. 13A and FIG. 13B which are equal to those in FIG. 5A and FIG. 5B indicate parts having identical functions. In this embodiment, a width of the plate-like control electrode 4 is gradually narrowed over a whole area ranging from a boundary between a display region AR and an external non-display region NR to an end portion of the external non-display region NR including a pressing member.

In this embodiment, the mechanical strength of the plate-like control electrode 4 is gradually reduced by gradually narrowing the width of the whole area ranging from the display region AR to the end portion including the external non-display region NR of the plate-like control electrode 4. With the use of the plate-like control electrode 4 having the constitution of this embodiment, in an operational step for mounting the plate-like control electrodes 4 to the back substrate 1, it is possible to reduce the occurrence of cracks, breaking or deformation of the plate-like control electrodes 4 in the vicinity of the boundary between the display region AR and the external non-display region NR, whereby the operability at the time of assembling is enhanced and the reduction of yield factor of the product is suppressed, and the occurrence of cracks, breaking or deformation of the plate-like control electrode 4 which may be caused by the thermal expansion at the time of operation after becoming a part of a product can be reduced thus providing a highly reliable display device.

In the above-mentioned ninth embodiment to eleventh embodiment, the example in which the strength of the plate-like control electrode 4 is controlled by changing the width of the plate-like control electrode has been explained. However, this example merely constitutes one example and it is sufficient to change the width of the plate-like control electrode 4 at least in a portion of the external non-display region NR according to the present invention.

Further, in order to change the strength of the plate-like control electrode 4 at least in the portion of the external non-display region NR, the first embodiment to the eleventh embodiment may be combined with each other. Due to such combinations, it is possible to make the plate-like control electrode 4 have either the substantially equal strength or the gradually changing strength in the external non-display region NR.

Figure 14:
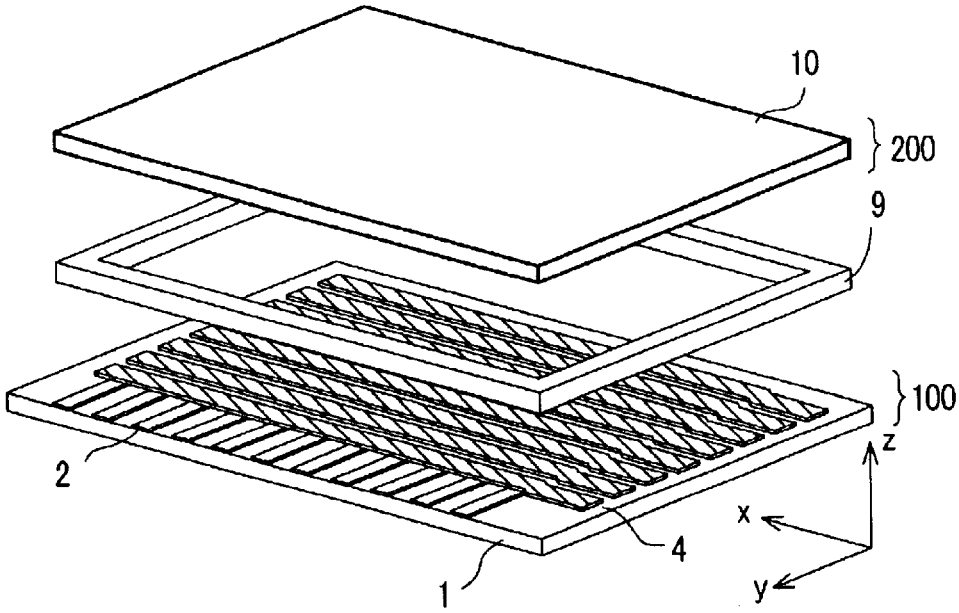
FIG. 14 is a developed perspective view for schematically explaining an overall constitution of the display device of the present invention.

FIG. 14 is a developed perspective view for schematically explaining the overall constitution of the display device of the present invention. Numeral 100 indicates a back panel and numeral 200 indicates a front panel. On the inner surface of the back-substrate 1 which constitutes the back panel 100, a large number of cathode lines 2 which extend in one direction (y direction) and are arranged in parallel in another direction (x direction) which crosses one direction are formed. Electron sources such as carbon nanotubes are formed on the cathode lines 2. Further, a plurality of plate-like control electrodes 4 which extend in another direction (x direction) which crosses the cathode lines 2 and are arranged in parallel in the above-mentioned one direction (y direction) are provided. Further, anodes and phosphors are formed on an inner surface of a front substrate 10 which constitutes the front panel. The back panel 100 and the front panel 200 are sealed by a sealing frame 9.

Figure 15:
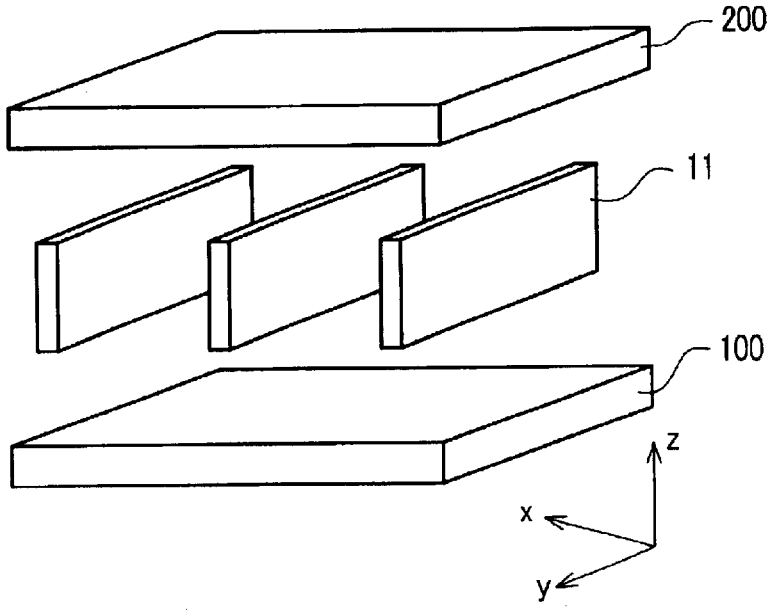
FIG. 15 is an explanatory view showing one example of a structure which holds a distance between a back panel and a front panel of the display device of the present invention at a given value.

FIG. 15 is en explanatory view of one example of the structure which holds a distance between the back panel 100 and the front panel 200 of the display device of the present invention at a given value. The back panel 100 and the front panel 200 have inner peripheries thereof laminated to each other while interposing the sealing frame 9 therebetween. The inside defined by laminating the back panel 100 and the front panel 200 using the sealing frame 9 is evacuated. Accordingly, only when these panels are merely laminated to each other, an atmospheric pressure is applied to a display region AR and hence, the distance between both panels differs between the center portion and the peripheral portion. To cope with such a situation, distance holding members 11 are provided between the back panel 100 and the front panel 200.

Figure 16:
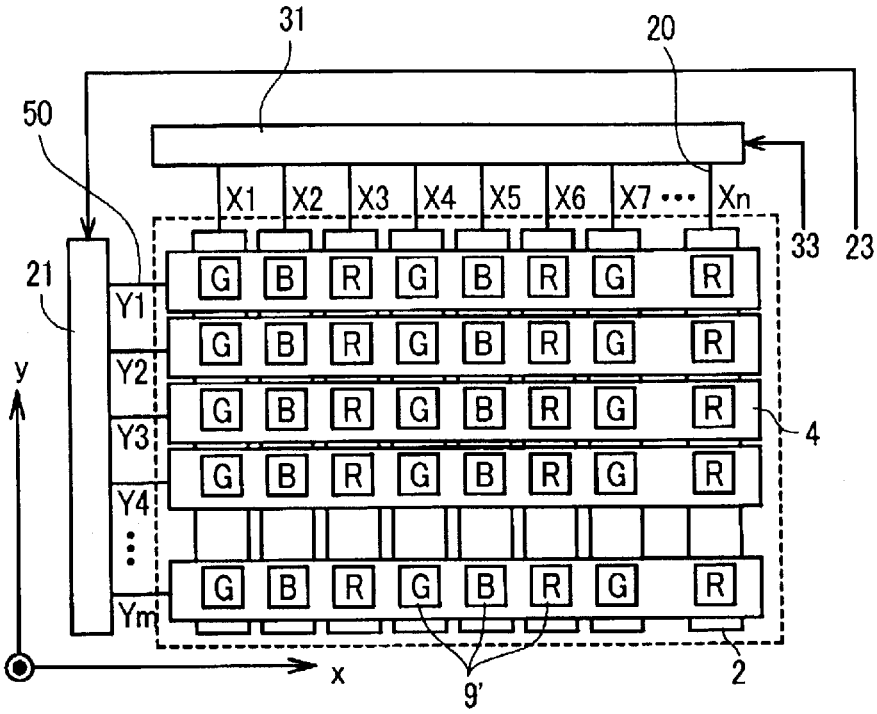
FIG. 16 is an explanatory view showing an example of an equivalent circuit of a display device of the present invention.
Figure 17:
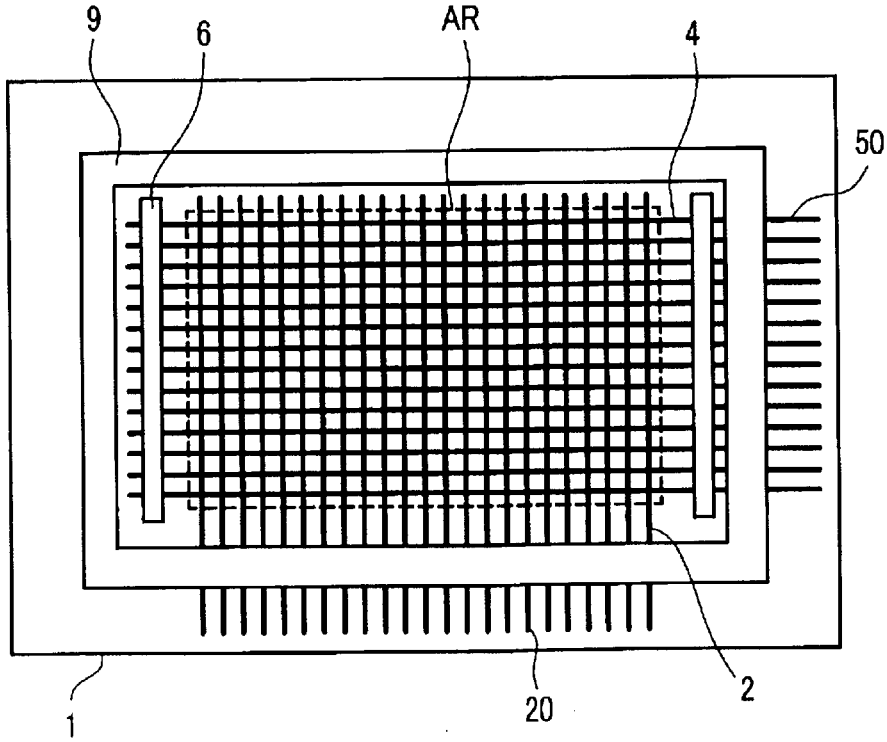
FIG. 17 is a plan view of a back panel for explaining the schematic constitution of a field emission type display device.

FIG. 16 is an explanatory view of an example of an equivalent circuit of the display device of the present invention. A region indicated by a broken line in the drawing is a display region and the cathode lines 2 and the plate-like control electrodes 4 are arranged such that they cross each other thus forming a matrix array of n×m in the display region. Each crossing portion of the matrix constitutes a unit pixel and one color pixel is constituted of a group consisting of "R", "G", "B" indicated by 9' in the drawing. The cathode lines 2 are connected to a video driving circuit 31 through cathode line lead lines 20 (X1, X2, . . . Xn), while the plate-like control electrodes 4 are connected to a control driving circuit 21 through control electrode lead lines 50 (Y1, Y2, . . . Ym).

Video signals 33 are inputted to the video driving circuit 31 from an external signal source, while control signals (synchronous signals) 23 are inputted to the control driving circuit 21 in the same manner. In a monochroic display device, each crossing portion of the matrix constitutes one pixel, while in a color display device, one group consisting of respective crossing portions R, G, B of the matrix constitutes one color pixel.

Due to such a constitution, given pixels which are sequentially selected by the control electrodes 4 and the cathode lines 2 emit light with given colored lights thus displaying a two-dimensional image. With the provision of the display device having this constitutional example, it is possible to realize a flat panel type display device of high efficiency using a relatively low voltage.

As has been explained heretofore, by adopting the constitutions of the present invention, there is no possibility that the mechanical strength of the plate-like control electrode provided to the back panel is sharply changed at the boundary portion between the display region AR and the external non-display region NR or the fixing portion whereby the operability of assembling is enhanced, the reduction of yield factor of products is suppressed, and the occurrence of cracks, breaking or deformation of the plate-like control electrodes which may be caused by the thermal expansion at the time of operation after becoming the product can be reduced thus providing the highly reliable display device.

What is claimed is:

1. A display device comprising a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, wherein the control electrodes are formed of plate-like control electrodes, the plate-like control electrode includes electron passing holes which allow electrons emitted from the electron sources to pass therethrough in the display region, the plate-like control electrode has a portion which is fixed to the back substrate in an external non-display region, and the plate-like control electrode has a region where the strength of the plate-like control electrode is gradually changed toward an end portion thereof in the extending direction in at least a portion of the external non-display region.

2. A display device according to claim 1, wherein the plate-like control electrode has a region where the strength is gradually increased toward the end portion in the extending direction.

3. A display device according to claim 1, wherein the strength of the plate-like control electrode is gradually increased from a boundary of the display region to a portion which is fixed to the back substrate.

4. A display device according to claim 1, wherein the strength of the plate-like control electrode is gradually increased from a portion which is fixed to the back substrate toward an end portion in the extending direction of the plate-like control electrode.

5. A display device according to claim 1, wherein the plate-like control electrode has the strength in the vicinity of a boundary of the display region which is substantially equal to the strength within the display region, and the strength is gradually increased from an intermediate portion of the external non-display region toward the end portion in the extending direction.

6. A display device according to claim 1, wherein the plate-like control electrode has the strength in a range from a boundary of the display region to a portion which is fixed to the back substrate which is substantially equal to the strength within the display region, and the strength is gradually increased outside the portion which is fixed to the back substrate toward the end portion in the extending direction.

7. A display device according to claim 1, wherein the plate-like control electrode has holes in at least a portion of the external non-display region.

8. A display device according to claim 1, wherein the plate-like control electrode has protrusions which protrude toward the back substrate side in the display region and the external non-display region.

9. A display device according to claim 1, wherein the plate-like control electrode includes a region where the width of the plate-like control electrode is gradually reduced toward the end portion in the extending direction in at least a portion of the external non-display region.

10. A display device according to claim 1, wherein the plate-like control electrode is fixed to the back substrate even within the display region.

11. A display device comprising a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, wherein the control electrodes are formed of plate-like control electrodes, the plate-like control electrode includes electron passing holes which allow electrons emitted from the electron sources to pass therethrough in the display region, the plate-like control electrode has a portion which is fixed to the back substrate in an external non-display region, and holes are formed in at least a portion of the external non-display region.

12. A display device according to claim 11, wherein the holes in the external non-display region are formed in a pattern which is substantially equal to a pattern of the electron passing holes formed within the display region.

13. A display device according to claim 11, wherein the holes in the external non-display region are formed over a substantially entire area of the external non-display region in a pattern substantially equal to a pattern of the electron passing holes formed within the display region.

14. A display device according to claim 11, wherein the plate-like control electrode has a region where pitches of the holes of the external non-display region are gradually increased toward an end portion in the extending direction of the plate-like control electrode.

15. A display device according to claim 11, wherein the holes of the external non-display region are formed in a pattern which is substantially equal to a pattern of the electron passing holes in the vicinity of a boundary of the display region and pitches of the holes are gradually increased toward an end portion in the extending direction of the plate-like control electrode from an intermediate portion of the external non-display region.

16. A display device according to claim 11, wherein the plate-like control electrode has a region where diameters of the holes of the external non-display region are gradually decreased toward an end portion in the extending direction of the plate-like control electrode.

17. A display device according to claim 11, wherein the holes of the external non-display region are formed in a pattern which is substantially equal to a pattern of the electron passing holes in the vicinity of a boundary of the display region and diameters of the holes are gradually decreased toward an end portion in the extending direction of the plate-like control electrode from an intermediate portion of the external non-display region.

18. A display device according to claim 11, wherein the plate-like control electrode has a region where pitches of the holes of the external non-display region are gradually increased toward an end portion in the extending direction of the plate-like control electrode, and the plate-like control electrode has a region where diameters of the holes of the external non-display region are gradually decreased toward the end portion in the extending direction of the plate-like control electrode.

19. A display device according to claim 11, wherein a pattern of the holes of the external non-display region is formed such that the holes are changed into non-penetrating recessed portion from an intermediate portion of the external non-display region toward an end portion in the extending direction of the plate-like control electrode.

20. A display device according to claim 11, wherein the plate-like control electrode is fixed to the back substrate even within the display region.

21. A display device comprising a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, wherein the control electrodes are formed of plate-like control electrodes, the plate-like control electrode includes electron passing holes which allow electrons emitted from the electron sources to pass therethrough in the display region, the plate-like control electrode has a portion which is fixed to the back substrate in an external non-display region, and holes are formed in at least a portion of the external non-display region, the external non-display region has a region in which a width of the plate-like control electrode is gradually narrowed toward an end portion in the extending direction at least in a portion thereof.

22. A display device according to claim 21, wherein the plate-like control electrode has a region where diameters of the holes of the external non-display region are gradually decreased toward the end portion in the extending direction of the plate-like control electrode.

23. A display device according to claim 21, wherein the plate-like control electrode has a region in which the width of the plate-like control electrode is gradually decreased toward the end portion in the extending direction and a subsequent region in which the width of the plate-like control electrode is substantially fixed in at least a portion of the external non-display region.

24. A display device according to claim 21, wherein the plate-like control electrode is fixed to the back substrate even within the display region.

25. A display device comprising a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, wherein the control electrodes are formed of plate-like control electrodes, the plate-like control electrode includes electron passing holes which allow electrons emitted from the electron sources to pass therethrough in the display region, includes a portion which is fixed to the back substrate in the external non-display region, and includes protrusions which protrude toward the back substrate side in the display region and in the external non-display region, and at least in a portion of the external non-display region, the protrusions are formed such that a gap between the neighboring protrusions as measured in the extending direction toward an end portion in the extending direction of the plate-like control electrode is set substantially equal and an arrangement pitch in the extending direction is gradually increased.

26. A display device comprising a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, wherein the control electrodes are formed of plate-like control electrodes, the plate-like control electrode includes electron passing holes which allow electrons emitted from the electron sources to pass therethrough in the display region, includes a portion which is fixed to the back substrate in the external non-display region, and includes protrusions which protrude toward the back substrate side in the display region and in the external non-display region, and at least in a portion of the external non-display region, the protrusions are formed such that a gap between the neighboring protrusions as measured in the extending direction toward an end portion in the extending direction of the plate-like control electrode is gradually decreased and an arrangement pitch in the extending direction is set substantially the same.

27. A display device comprising a back substrate which has a plurality of cathode lines which extend in one direction, are arranged in parallel in another direction which crosses one direction and include electron sources respectively, and a plurality of control electrodes which cross the cathode lines in a non-contact manner within a display region, extend in another direction and are arranged in parallel in one direction on an inner surface thereof, and a front substrate which has anodes and phosphors on an inner surface thereof and faces the back substrate with a given distance therebetween, wherein the control electrodes are formed of plate-like control electrodes, the plate-like control electrode includes electron passing holes which allow electrons emitted from the electron sources to pass therethrough in the display region, includes a portion which is fixed to the back substrate in the external non-display region, and includes protrusions which protrude toward the back substrate side in the display region and in the external non-display region, and at least in a portion of the external non-display region, the protrusions are formed such that a gap between the neighboring protrusions as measured in the extending direction toward an end portion in the extending direction of the plate-like control electrode is gradually decreased and an arrangement pitch in the extending direction is gradually increased.

28. A display device according to claim 25, wherein the plate-like control electrode includes holes at least in a portion of the external non-display region.

29. A display device according to claim 25, wherein the plate-like control electrode has indented portions on the front substrate side at positions corresponding to the protrusions in the external non-display region.

30. A display device according to claim 25, wherein the plate-like control electrode is fixed to the back substrate even in the display region.

* * * * *